US011378901B2

(12) United States Patent
Iwasawa et al.

(10) Patent No.: US 11,378,901 B2
(45) Date of Patent: Jul. 5, 2022

(54) IMAGE FORMING APPARATUS CAPABLE OF SUPPRESSING MALDISTRIBUTION OF AN ION CONDUCTIVE AGENT ON AN INTERMEDIARY TRANSFER MEMBER

(71) Applicant: CANON KABUSHIKI KAISHA, Tokyo (JP)

(72) Inventors: Yusaku Iwasawa, Shizuoka (JP); Yasutaka Yagi, Shizuoka (JP); Ken Yokoyama, Shizuoka (JP); Hiroyuki Seki, Meridian, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/342,134

(22) Filed: Jun. 8, 2021

(65) Prior Publication Data

US 2021/0382416 A1 Dec. 9, 2021

(30) Foreign Application Priority Data

Jun. 9, 2020 (JP) ..... JP2020-100558

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
CPC ..... G03G 15/1645; G03G 15/1675
USPC ..... 399/66
See application file for complete search history.

(56) References Cited

U.S. PATENT DOCUMENTS

| | | | | |
|---|---|---|---|---|
| 9,411,271 | B2 | 8/2016 | Matsushita | |
| 10,761,458 | B2 | 9/2020 | Takeuchi | |
| 10,824,105 | B2 | 11/2020 | Nakai et al. | |
| 2016/0223956 | A1* | 8/2016 | Nakaegawa | G03G 15/1675 |

FOREIGN PATENT DOCUMENTS

| | | | |
|---|---|---|---|
| JP | 10-247021 | A | 9/1998 |
| JP | 2015-222407 | A | 12/2015 |
| JP | 6501543 | B2 | 4/2019 |
| JP | 2020-034699 | A | 3/2020 |

* cited by examiner

*Primary Examiner* — William J Royer
(74) *Attorney, Agent, or Firm* — Venable LLP

(57) ABSTRACT

An image forming apparatus includes image bearing members, an intermediary transfer member having ion conductivity, primary transfer members, a first voltage applying portion, a secondary transfer member, a second voltage applying portion, and a controller. On the basis of image information, the controller controls a transfer voltage applied to the secondary transfer member so as to be different between a first voltage when a first region, in which a coverage indicating a ratio occupied by an image region per predetermined area is a first coverage passes through the secondary transfer portion and a second voltage when a second region, in which the coverage is a second coverage larger than the first coverage, passes through the secondary transfer portion. The controller controls a change amount of the first voltage with respect to the second voltage so as to be different between a first mode and a second mode.

24 Claims, 8 Drawing Sheets

IMAGE FORMING APPARATUS CAPABLE OF SUPPRESSING MALDISTRIBUTION OF AN ION CONDUCTIVE AGENT ON AN INTERMEDIARY TRANSFER MEMBER

FIELD OF THE INVENTION AND RELATED ART

The present invention relates to an image forming apparatus, such as a copying machine, a printer, or a facsimile machine, of an electrophotographic type or an electrostatic recording type.

As a conventional image forming apparatus, such as the copying machine, the printer, or the facsimile machine, of, e.g., an electrophotographic type, an image forming apparatus of an intermediary transfer type in which a toner image formed on an image bearing member is primary-transferred onto an intermediary transfer member and then is secondary-transferred onto a recording material such as paper for recording has been known. As the intermediary transfer member, an intermediary transfer belt constituted by an endless belt has been widely used. In recent years, in such an image forming apparatus of the intermediary transfer type, as an electroconductive agent for the intermediary transfer belt, an electroconductive agent having an ion conductive property (hereinafter, also referred to as an "ion conductive agent") is used. The intermediary transfer belt assuming the ion conductive property as an electroconductive form has, for example, the following advantage compared with an intermediary transfer belt having an electron conductive property which is another principal electroconductive form. That is, when an intermediary transfer belt of which electric resistance is a medium resistance is prepared, a target resistance value is easily obtained. Further, a degree of a resistance fluctuation by long-term use is small. On the other hand, as regards the ion-conductive intermediary transfer belt, when a current is continuously applied in one direction, dissociation or maldistribution (hereinafter, also simply referred to as "maldistribution") of the ion conductive agent in the intermediary transfer belt occurs in some instances. Further, by this, the ion conductive agent causes bleed out to a surface of the intermediary transfer belt and the resistance of the intermediary transfer belt increases in some instances. When the ion conductive agent causes the bleed out, due to contamination of another member contacting the surface of the intermediary transfer belt with the ion conductive agent, there arises a problem in some instances. For example, when the ion conductive agent deposits on a free end portion of a cleaning blade provided for removing toner remaining on the intermediary transfer belt, a cleaning performance of the cleaning blade lowers, so that improper cleaning occurs in some instances.

As countermeasures against such a bleed out phenomenon of the ion conductive agent, techniques as disclosed in Japanese Laid-Open Patent Application (JP-A) Hei 10-247021 and Japanese Patent No. 6501543 have been known. That is, it is effective that an adjusting operation in which during non-image formation, a voltage of an opposite polarity to a polarity of the voltage during image formation is applied to the intermediary transfer belt is carried out and thus a balance between a normal direction integrated current value of a current flowing through the intermediary transfer belt in the same direction as a direction during the image formation and an opposite direction integrated current value of a current flowing through the intermediary transfer belt in a direction opposite to the direction during the image formation is achieved. Thus, by achieving the balance of the value of the current flowing through the intermediary transfer belt, it is possible to suppress the maldistribution of the ion conductive agent.

However, in the case where the number of continuous print sheets in a printing job is large or in the like case, the balance of the value of the current flowing through the intermediary transfer belt is largely biased, so that the maldistribution of the ion conductive agent progresses in some instances. For example, as described later, if continuous printing in a large amount is executed in an operation in a full-color image mode, maldistribution of a cationic electroconductive agent occurs on the surface of the intermediary transfer belt in some instances. Further, in the case where the continuous printing in the large amount is executed in an operation in a monochromatic mode, maldistribution of an anionic electroconductive agent occurs on the surface of the intermediary transfer belt in some instances.

Thus, in the case where the maldistribution of the ion conductive agent progresses, in order to sufficiently achieve the balance of the current amount by the adjusting operation during the non-image formation as disclosed in JP-A Hei 10-247021 and Japanese Patent No. 6501543, there is a need to execute the adjusting operation many times in some cases. However, when the adjusting operation is executed many times, downtime (period in which an image cannot be outputted) increases, so that not only printing productivity lowers, but also an operating time of the image forming apparatus increases and a lifetime of the apparatus and members is shortened in some instances.

SUMMARY OF THE INVENTION

A principal object of the present invention is to provide an image forming apparatus capable of suppressing peripheral surface maldistribution of an ion conductive agent on an intermediary transfer member while suppressing downtime.

According to an aspect of the present invention, there is provided an image forming apparatus comprising: a plurality of image bearing members each configured to bear a toner image; an intermediary transfer member configured to feed the toner image, primary-transferred from each of the image bearing members, for secondary-transferring the toner image onto a recording material, the intermediary transfer member being a rotatable endless member having ion conductivity; a plurality of primary transfer members provided corresponding to the image bearing members, respectively, and each configured to form a primary transfer portion where the toner image is primary-transferred from the corresponding image bearing member onto the intermediary transfer member, wherein each of the primary transfer members primary-transfers the toner image from the corresponding image bearing member onto the intermediary transfer member under application of a first transfer voltage thereto; a first applying portion configured to apply the first transfer voltage to the primary transfer members; a secondary transfer member configured to form a secondary transfer portion where the toner image is secondary-transferred from the intermediary transfer member onto the recording material, wherein the secondary transfer member secondary-transfers the toner image from the intermediary transfer member onto the recording material under application of a second transfer voltage thereto; a second applying portion configured to apply the second transfer voltage to the secondary transfer member; and a controller configured to carry out control of the second applying portion, wherein on the basis of image information, image formation is carried out in an operation in a first mode and in an operation in a second mode in which a number of the image bearing members on which the toner image is formed is less than in the first mode and in which a number of the primary transfer members to which the first transfer voltage is applied is less than in the first mode, wherein on the basis of the image information, the controller controls the second transfer voltage applied to the secondary transfer member during the secondary transfer of an image formed on a single recording material so as to be different between a first voltage when a first region in which a coverage indicating a ratio occupied by an image region per predetermined area is a first coverage passes through the secondary transfer portion and a second voltage when a second region in which the coverage is a second coverage larger than the first coverage passes through the secondary transfer portion, and wherein the controller controls a change amount of the first voltage with respect to the second voltage so as to be different between the first mode and the second mode.

Further features of the present invention will become apparent from the following description of exemplary embodiments with reference to the attached drawings.

Figure 3:
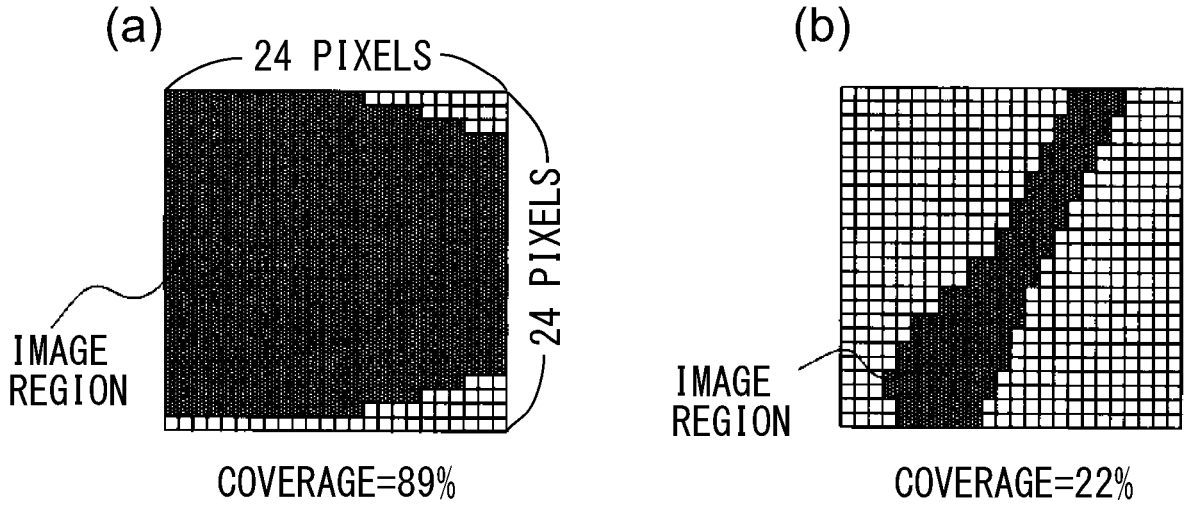

Parts (a) and (b) of FIG. 3 are schematic views each for illustrating a coverage in a unit block.

Figure 4:
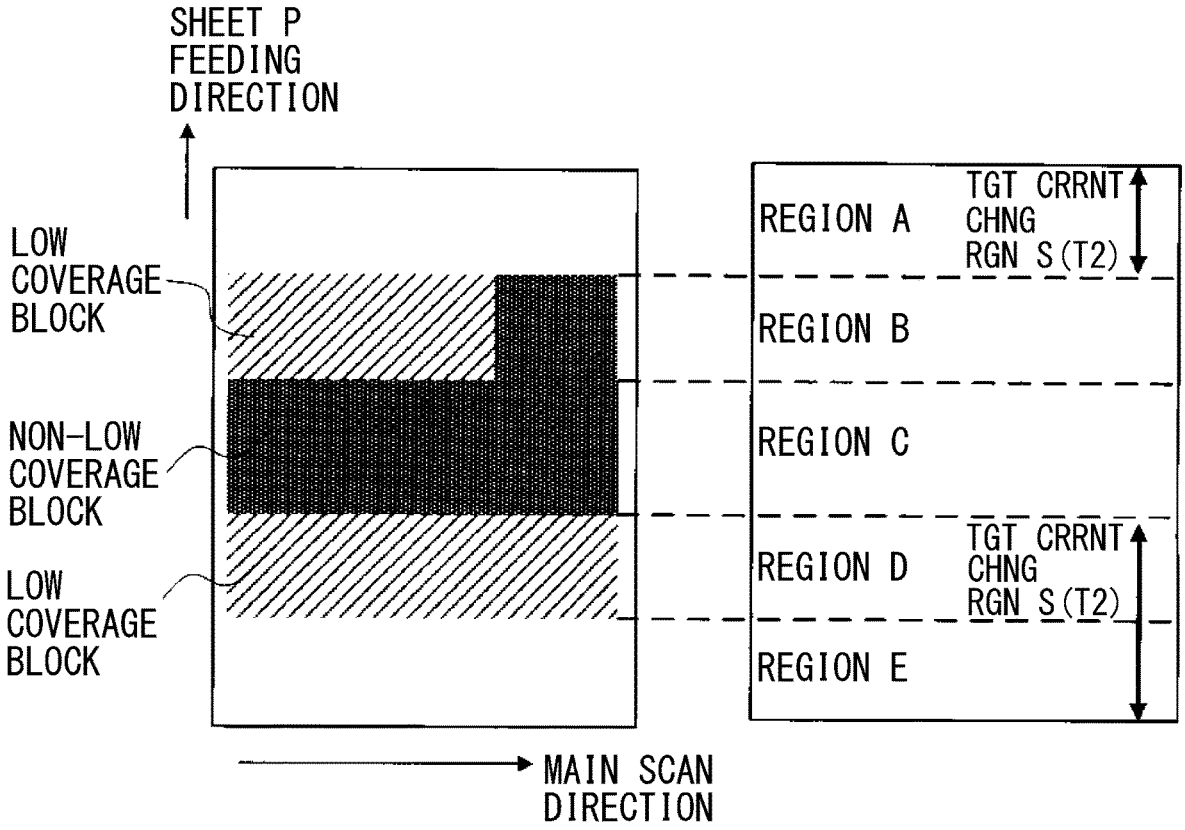

FIG. 4 is a schematic view for illustrating a target current value change region.

Figure 5:
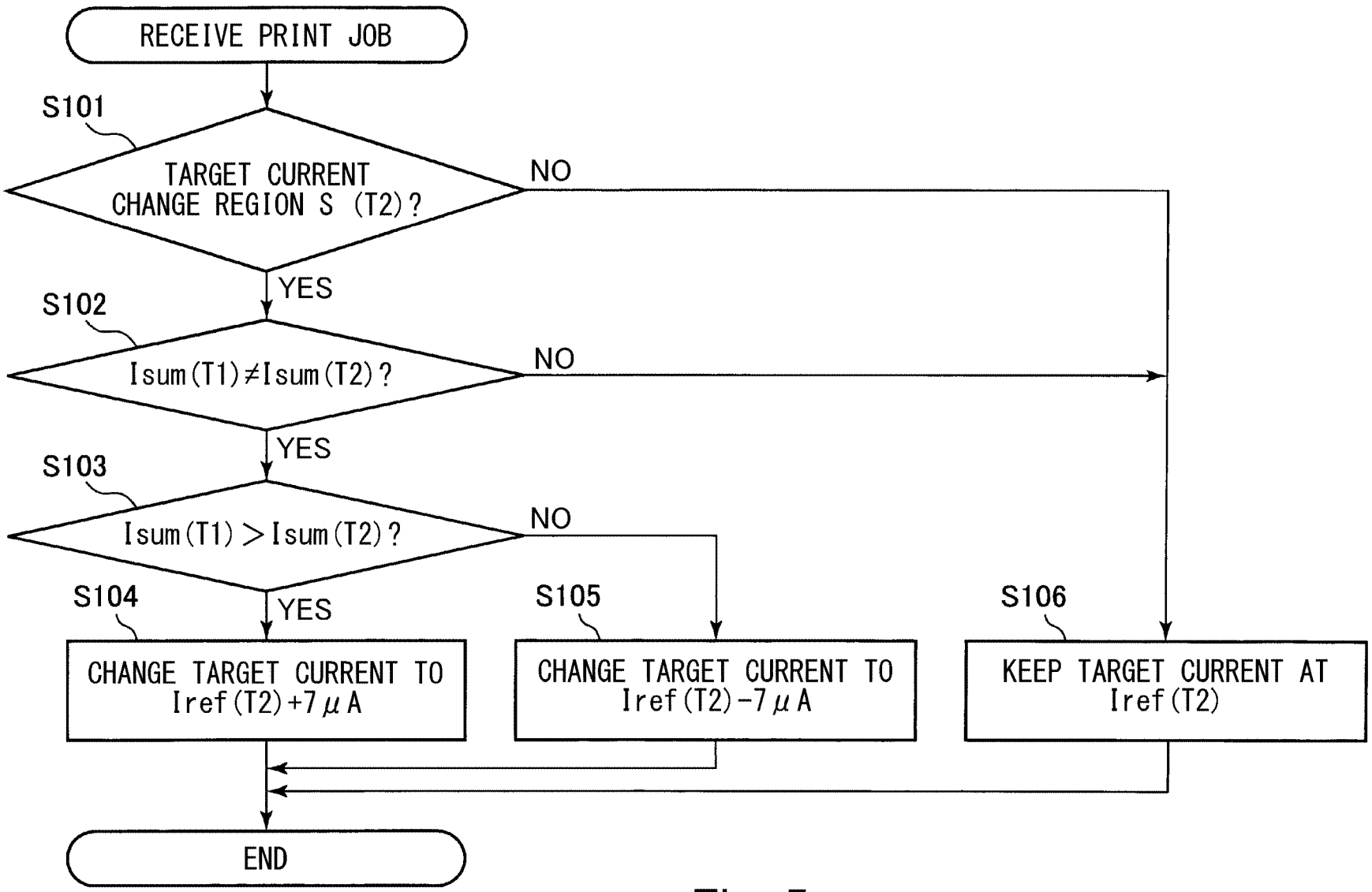

FIG. 5 is a flowchart of control for determining a change amount of a target current value in an embodiment 1.

Figure 6:
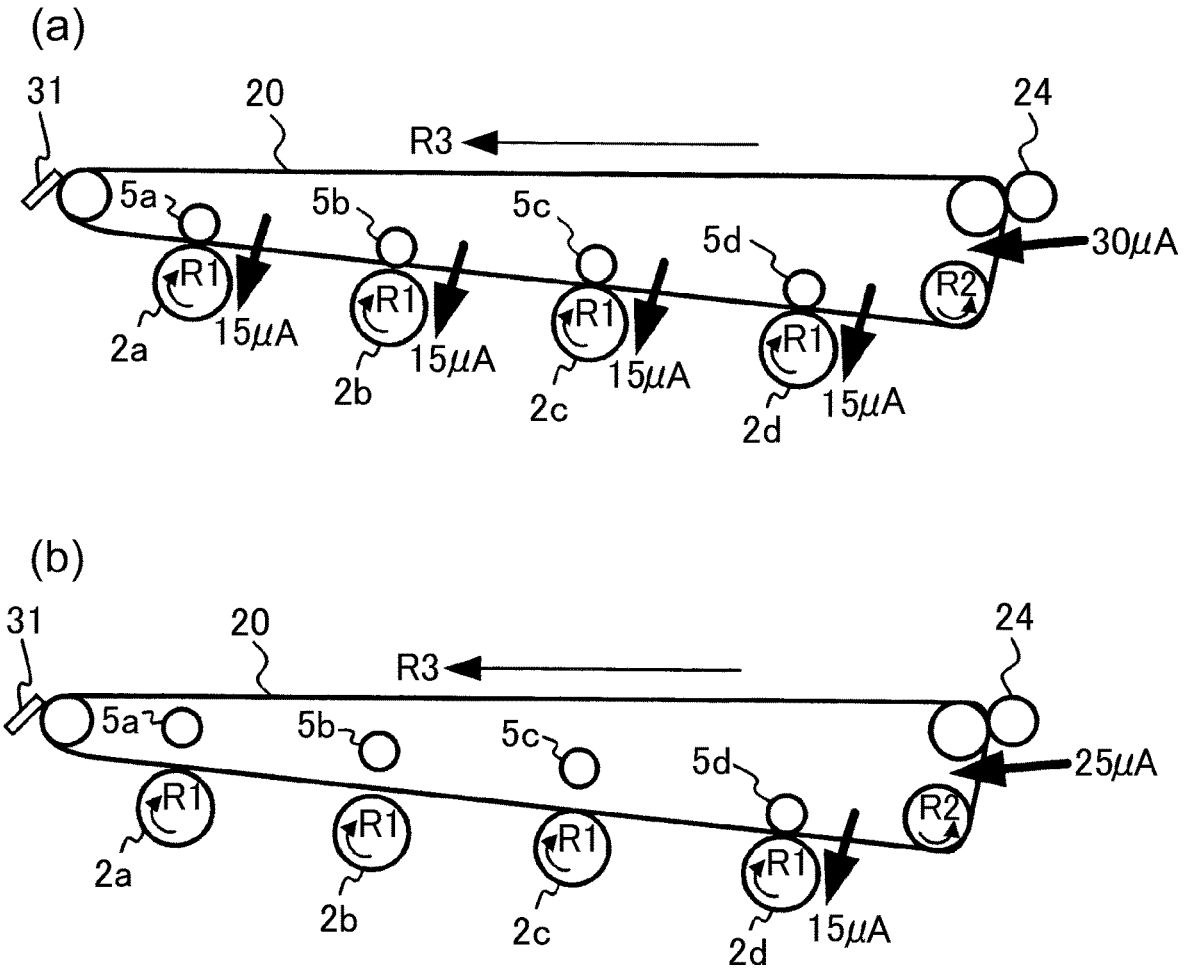

Parts (a) and (b) of FIG. 6 are schematic views for illustrating amounts of currents flowing through an intermediary transfer belt in operations in a full-color image mode and a monochromatic mode, respectively.

Figure 7:
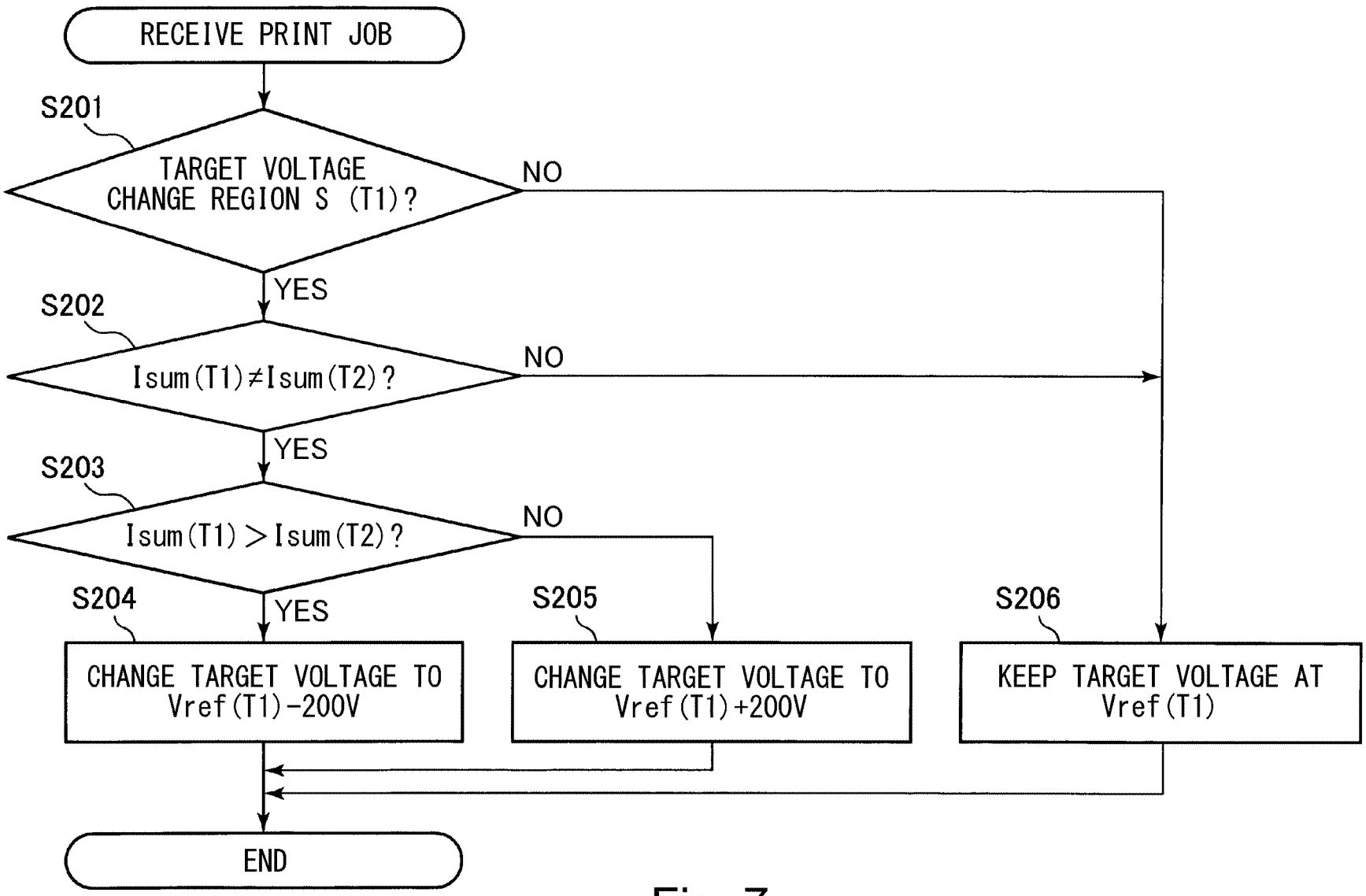

FIG. 7 is a flowchart of control for determining a change amount of a target current value in an embodiment 2.

Figure 8:
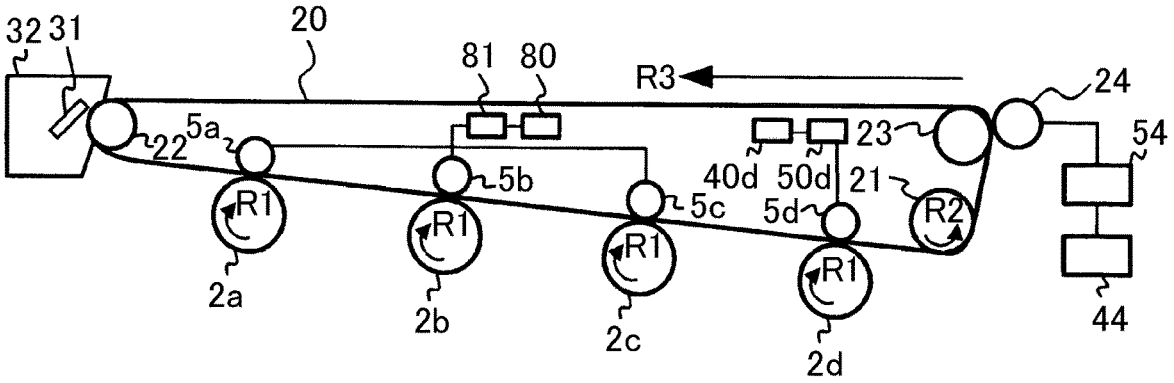

FIG. 8 is a schematic view of a structure in which commonality of a primary transfer voltage source is achieved.

Figure 9:
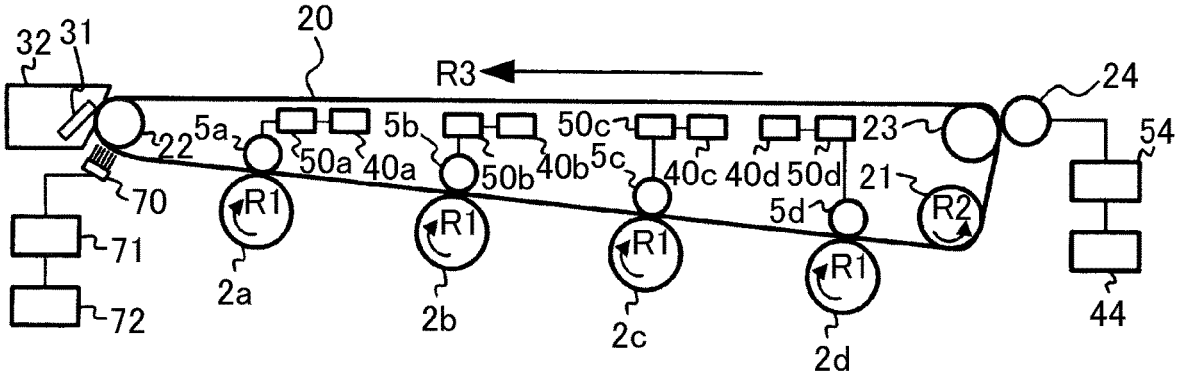

FIG. 9 is a schematic view of a principal part of an image forming apparatus according to an embodiment 3.

FIG. 10 is a schematic view for illustrating a modified embodiment in which a balance of a current amount is calculated in every region of an intermediary transfer belt with respect to a circumferential direction of the intermediary transfer belt.

DESCRIPTION OF EMBODIMENTS

An image forming apparatus according to the present invention will be described specifically with reference to the drawings.

Embodiment 1

(1) Image Forming Apparatus

Figure 1:
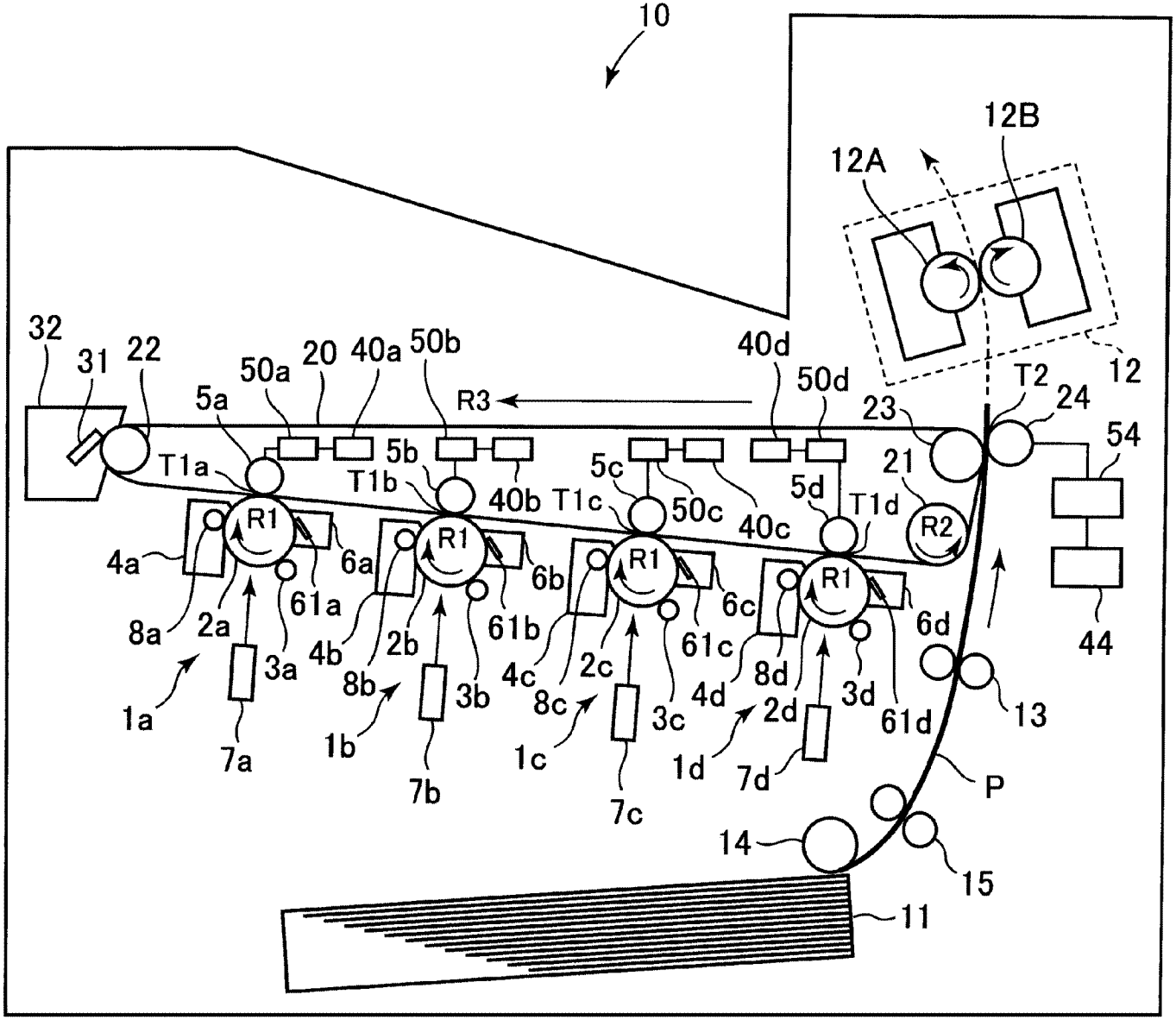
FIG. 1 is a schematic sectional view of an image forming apparatus.

FIG. 1 is a schematic sectional view of an image forming apparatus 10 in this embodiment according to the present invention.

The image forming apparatus 10 in this embodiment is a full-color laser beam printer capable of forming a full-color image by using an electrophotographic method and by employing an in-line method and an intermediary transfer method.

The image forming apparatus 10 includes, as a plurality of image forming means, first to fourth image forming portions (stations) 1*a*, 1*b*, 1*c* and 1*d* for forming images of yellow (Y), magenta (M), cyan (C) and black (K), respectively. The image forming portions 1*a* to 1*d* are disposed in line at regular intervals. Elements which are provided for the respective colors and which have the same or corresponding functions or constitutions in the image forming portions 1*a* to 1*d* are collectively described in some instances by omitting suffixes a, b, c, and d for representing the elements for associated colors. In this embodiment, the image forming portion 1 is constituted by including a photosensitive drum 2 (2*a*, 2*b*, 2*c*, 2*d*), a charging roller 3 (3*a*, 3*b*, 3*c*, 3*d*), an exposure device 7 (7*a*, 7*b*, 7*c*, 7*d*), a developing device 4 (4*a*, 4*b*, 4*c*, 4*d*), a primary transfer roller 5 (5*a*, 5*b*, 5*c*, 5*d*), and a drum cleaning device 6 (6*a*, 6*b*, 6*c*, 6*d*). Incidentally, as regards magnitudes (high and low values) of a current and a voltage, for convenience, those in the case where absolute values thereof are compared with each other will be described. The image forming apparatus 10 includes the photosensitive drum 2 which is a rotatable drum-shaped (cylindrical) electrophotographic photosensitive member. In this embodiment, the photosensitive drum 2 is a negatively chargeable OPC (organic photoconductor) photosensitive member and includes a drum base made of aluminum and a photosensitive layer formed on the drum base. The photosensitive drum 2 is rotationally driven at a predetermined peripheral speed (surface movement speed) in an arrow R1 direction (clockwise direction) in FIG. 1 by a driving device (not shown). In this embodiment, this peripheral speed of the photosensitive drum 2 corresponds to a process speed of the image forming apparatus 10. When an image formation start signal is sent, the photosensitive drum 2 is rotationally driven at a predetermined process speed.

A surface of the rotating photosensitive drum 2 is electrically charged uniformly to a predetermined polarity (negative in this embodiment) and a predetermined potential by the charging roller 2 which is a charging member of a roller type. The charging roller 3 contacts the surface of the photosensitive drum 2 at a predetermined press-contact force. During a charging step, to the charging roller 3, a predetermined charging voltage is applied by an unshown charging voltage source (high-voltage source circuit) as a charging voltage application means.

The charged surface of the photosensitive drum 2 is subjected to scanning exposure depending on an image signal of a color component corresponding to the associated one of the image forming portions 1, by the exposure device (laser scanner device) 7, so that on the photosensitive drum 2, an electrostatic latent image (electrostatic image) is formed. The exposure device 7 converts the image signal, of the color component corresponding to the image forming portion 1, inputted from an ASIC 314 (FIG. 2) described later into a light signal in a laser outputting portion. Then, the exposure device 7 subjects the uniformly charged surface of the photosensitive drum 2 to scanning exposure with laser light, which is the converted light signal, so that the electrostatic latent image is formed on the photosensitive drum 2. In this embodiment, in the exposure device 7, the laser light modulated correspondingly to a time-series electric digital pixel signal of image information inputted from a host computer (FIG. 2) (described later) is outputted from the laser outputting portion. Then, in the exposure device 7, this laser light is emitted to the surface of the photosensitive drum 2 through a reflection mirror.

The electrostatic latent image formed on the photosensitive drum 2 is developed (visualized) with toner as a developer supplied by the developing device 4 as a developing means, so that a toner image is formed on the photosensitive drum 2. In this embodiment, the developing provided 4 is of one-component contact development type. The developing device 4 includes a developing roller 8 as a developer carrying member. The developing roller 8 carries thereon the toner in a thin layer shape and feeds the toner to a developing position opposing the photosensitive drum 2 by being rotationally driven by a driving provided (not shown). Further, during a developing step, to the developing roller 8, a predetermined developing voltage is applied by an unshown developing voltage source (high-voltage source circuit) as a developing voltage application means. By this, the toner is electrostatically attracted to the surface of the photosensitive drum 2 depending on a surface potential of the photosensitive drum 2, so that the electrostatic latent image is developed into the toner image.

In this embodiment, the toner charged to the same polarity as a charge polarity of the photosensitive drum 2 is deposited on an exposed portion (image portion) of the photosensitive drum 2 lowered in absolute value of the potential by the exposure to light after the photosensitive drum 2 is uniformly charged (reverse development type). In this embodiment, a normal charge polarity of the toner is a negative polarity, and the toner for forming the toner image principally includes negative electric charge. Incidentally, in the developing devices 4*a* to 4*d*, toners of colors of yellow, magenta, cyan and black are accommodated, respectively. In the operation in the full-color image described later, all the developing rollers 8 of the four developing devices 4 contact the photosensitive drum 2. Further, in the operation in the monochromatic mode (black (single) color mode in this embodiment) described later, the developing rollers 8 of the developing devices 4 other than the developing device 4 of the image forming portion 1 (the image forming portion 1*d* for black in this embodiment) for forming the image are spaced from the photosensitive drum 2. This is because deterioration and consumption of the developing rollers 8 and the toners are suppressed.

An intermediary transfer belt 20 constituted by an endless belt as an intermediary transfer member is provided so as to oppose the four photosensitive drums 2*a* to 2*d*. The intermediary transfer belt 20 is extended and stretched with predetermined tension by, as a plurality of stretching rollers (supporting members), a driving roller 21, a cleaning opposite roller 22, and a secondary transfer opposite roller 23. The driving roller 21 is rotationally driven in an arrow R2 direction (counterclockwise direction in FIG. 1 by a driving device (not shown), so that the intermediary transfer belt 20 is rotated (circulated and moved) at a speed substantially equal to the peripheral speed of the photosensitive drum 2, i.e., the predetermined process speed in an arrow R3 direction (counterclockwise direction).

In an inner peripheral surface (back surface) side of the intermediary transfer belt 20, primary transfer rollers 5*a* to 5*d* which are roller-type primary transfer members as primary transfer means are provided correspondingly to the respective photosensitive drums 2. Each primary transfer roller 5 presses the intermediary transfer belt 20 toward the associated photosensitive drum 2 and forms a primary transfer portion (primary transfer nip) T1 (T1*a*, T1*b*, T1*c*, T1*d*) where the photosensitive drum 2 and the intermediary transfer belt 20 are in contact with each other.

As described above, the toner image formed on the photosensitive drum 2 is primary-transferred, at the primary transfer portion T1, onto the intermediary transfer belt 20 rotating in an arrow R1 direction in FIG. 1 by the action of the primary transfer roller 5. During a primary transfer step, to the primary transfer roller 5, a primary transfer voltage which is a DC voltage of an opposite polarity (positive polarity in this embodiment) to the normal charge polarity of the toner is applied by a primary transfer voltage source (high-voltage source circuit) 40 (40*a*, 40*b*, 40*c*, 40*b*) as a primary transfer voltage application means. For example, during full-color image formation, the toner images of the respective colors of yellow, magenta, cyan and black formed on the respective photosensitive drums 2*a* to 2*d* are successively primary-transferred superposedly onto the intermediary transfer belt 20.

In an outer peripheral surface (front surface) side of the intermediary transfer belt 20, at a position opposing the secondary transfer opposite roller 23, a secondary transfer roller 24 which is a roller-type secondary transfer member as a secondary transfer means is provided. The secondary transfer roller 24 is urged toward and contacted to the secondary transfer opposite roller 23 via the intermediary transfer belt 20, and forms a secondary transfer portion (secondary transfer nip) T2 where the intermediary transfer belt 20 and the secondary transfer roller 24 are in contact with each other.

The toner images formed on the intermediary transfer belt 20 as described above are secondary-transferred, at the secondary transfer portion T2, onto the recording material (transfer material, sheet) P such as paper sandwiched and fed by a intermediary transfer belt 20 and the secondary transfer roller 24 by the action of the secondary transfer roller 24. During a secondary transfer step, to the secondary transfer roller 24, a secondary transfer voltage which is a DC voltage of an opposite polarity (positive polarity in this embodiment) to the normal charge polarity of the toner is applied by a secondary transfer voltage source (high-voltage source circuit) 44 as a secondary transfer application means. The recording material P is accommodated in a cassette 11 as a recording material accommodating portion. The recording material P is fed from the cassette 11 by a feeding roller 14 as a sheet feeding member and is conveyed to a registration roller pair 13 by a conveying roller pair 15 as a feeding member. This recording material P is fed by the registration roller pair 13 as a feeding member to the secondary transfer portion T2 in synchronism with timing when a leading end of the toner image on the intermediary transfer belt 20 moves to the secondary transfer portion T2. The feeding roller 14, the conveying roller pair 15 and the registration roller pair 13 constitute a recording material supplying means.

The recording material P on which the toner images are transferred is fed to a fixing device 12 as a fixing means. The fixing device 12 includes a fixing roller 12A provided with a heat source and a pressing roller 12B press-contacting the fixing roller 12A. The fixing device 12 feeds the recording material P on which the (unfixed) toner images are carried, while heating and pressing the recording material P by the fixing roller 12A and the pressing roller 12B. The recording material P on which the toner images are fixed is discharged (outputted) to an outside of an apparatus main assembly of the image forming apparatus 10.

Further, the toner (primary transfer residual toner) remaining on the surface of the photosensitive drum 2 after the primary transfer step is removed and collected from the surface of the photosensitive drum 2 by the drum cleaning device 6 as a photosensitive member cleaning means. The drum cleaning device 6 includes a drum cleaning blade 61 (61*a*, 61*b*, 61*c*, 61*d*) which is a plate-like member formed by an elastic member such as a urethane rubber as a cleaning member and includes a collected toner container. The drum cleaning device 6 scrapes off the primary transfer residual toner from the surface of the rotating photosensitive drum 2 by the drum cleaning blade 61 contacting the photosensitive drum 2 and then the scraped-off toner is accommodated in the collected toner container.

Further, in the outer peripheral surface side of the intermediary transfer belt 20, at a position opposing the cleaning opposite roller 22, a belt cleaning device 32 as an intermediary transfer member cleaning means is provided. The toner (secondary transfer residual toner) remaining on the surface of the intermediary transfer belt 20 after the secondary transfer step is removed and collected from the surface of the intermediary transfer belt 20 by the belt cleaning device 32. The belt cleaning device 32 includes a drum cleaning blade 31 which is a plate-like member formed by an elastic member such as a urethane rubber as a cleaning member and includes a collected toner container. The drum cleaning device 6 scrapes off the secondary transfer residual toner from the surface of the rotating intermediary transfer belt 20 by the belt cleaning blade 31 contacting the intermediary transfer belt 20 and then the scraped-off toner is accommodated in the collected toner container.

In this embodiment, in each image forming portion 1, the photosensitive drum 2 and, as process means actable thereon, the charging roller 3, the developing device 4 and the drum cleaning device 6 integrally constitute a process cartridge detachably mountable to the apparatus main assembly of the image forming apparatus 10. The process cartridge is exchanged with a new (fresh) one, for example, in the case where the toner in the developing device 4 is used up or in the case where the photosensitive drum 2 reaches an end of its lifetime.

Further, in this embodiment, the intermediary transfer belt 20, the respective stretching rollers 21, 22 and 23, the respective primary transfer rollers 5, and the belt cleaning device 32 integrally constitute an intermediary transfer belt unit detachably mountable to the apparatus main assembly of the image forming apparatus 10. The intermediary transfer belt unit is exchanged with a new one, for example, in the case where the intermediary transfer belt 20 reaches an end of its lifetime.

(2) Transfer Constitution

In this embodiment, as a base resin material of a base material of the intermediary transfer belt 20, a polyethylene naphthalate (PEN) resin material was used. Incidentally, as the base resin material of the base material of the intermediary transfer belt 20, for example, it is possible to cite thermoplastic resin materials such as polycarbonate, polyvinylidene fluoride (PVDF), polyethylene, polypropylene, polymethylpentene-1, polystyrene, polyamide, polysulfone, polyalylate, polyethylene terephthalate, polyethylene naphthalate, polybutylene naphthalate, polybutylene naphthalate, polyphenylene sulfide, polyether sulfone, polyether nitrile, thermoplastic polyimide, polyether ether ketone, thermotropic liquid crystal polymer, and polyamide acid. Two or more species of these resin material can also be used in mixture.

Further, in this embodiment, the base material of the intermediary transfer belt 20 contains an electroconductive agent having an ion-conductive property (ion conductive agent) in order to impart electroconductivity to the intermediary transfer belt 20. By employing an ion-conductive intermediary transfer belt 20 containing the ion conductive agent, compared with the case where an electron-conductive intermediary transfer belt 20 containing an electroconductive agent having an electron-conductive property is used, a manufacturing tolerance of a resistance of the intermediary transfer belt 20 can be suppressed to a low level.

As the ion conductive agent, it is possible to cite a multivalent metal salt, a quaternary ammonium salt. As regards the quaternary ammonium salt, as a cationic portion, it is possible to cite tetraethylammonium ion, tetrapropylammonium ion, tetraisopropylammonium ion, tetrabutyl ammonium ion, tetrapentylammonium ion, tetrahexylammonium ion, and the like, and as an anionic portion, it is possible to cite halogen ion, and fluoroalkylsulfate ion, fluoroalkylsulfide ion, fluoroalkylborate ion which have 1-10 carbon atoms, and the like ions.

Further, as the ion conductive agent, an ionic liquid may also be used. The ionic liquid is a liquid consisting only of an ion, and refers to a salt which exists as a liquid in a wide temperature range and which has a melting point of particularly 100° C. or less. As an anionic species constituting the ionic liquid, it is possible to cite sulfonylimide ion, and as a cationic species constituting the ionic liquid, it is possible to cite ammonium-based ion, imidazolium-based ion, pyridium-based ion, piperidinum-based ion, pyrrolinium-based ion, phosphonium-based ion, and the like ion.

The above-described ingredients are melt-kneaded, and then, a molding method such as inflation molding, cylindrical extrusion molding or injection is appropriately selected, so that the intermediary transfer belt 20 as a resin composition can be obtained.

The intermediary transfer belt 20 may also include another layer by providing a protective layer on the surface of the above-described base material (base layer). That is, the intermediary transfer belt 20 may only be required to contain a layer formed of an electroconductive member having the ion-conductive property.

Incidentally, the intermediary transfer belt 20 in this embodiment has surface resistivity of $8.0\times10^9$ Ω/sq and volume resistivity of $5.0\times10^9$ Ωcm. The values of the resistivity were measurement at an applied voltage of 250 V by using a resistivity meter ("Hiresta UP", manufactured by Nittoseiko Analytech Co., Ltd.) and a URS probe dedicated thereto.

As the primary transfer roller 5, for example, it is possible to use a metal roller, an elastic roller provided with a layer (elastic layer) of an elastic member such as a sponge rubber, and the like roller. In this embodiment, as the primary transfer roller 5, a metal roller prepared by subjecting, to nickel plating, a surface of a roller which has a diameter of 6 mm and a cylindrical shape and which is made of SUS (stainless steel) was used. Further, in this embodiment, the primary transfer roller 5 is disposed downstream of the photosensitive drum 2 with respect to a feeding direction (surface movement direction, rotational direction) of the intermediary transfer belt 20 by being offset by 3-10 mm. In this embodiment, with respect to the feeding direction of the intermediary transfer belt 20, a contact portion between the photosensitive drum 2 and the intermediary transfer belt 20 and a contact portion between the intermediary transfer belt 20 and the primary transfer roller 5 do not overlap with each other. Further, the primary transfer roller 5 presses the intermediary transfer belt 20 from the inner peripheral surface (back surface) side toward the outer peripheral surface (front surface) side, and the other peripheral surface of the intermediary transfer belt 20 is contacted to an outer peripheral surface (front surface) of the photosensitive drum 2, so that the primary transfer portion T1 is formed between the intermediary transfer belt 20 and the photosensitive drum 2. In an operation in the full-color image mode described later, all four primary transfer rollers 5*a* to 5*d* contact the intermediary transfer belt 20. Further, in an operation in the monochromatic mode (a black (single color) mode in this embodiment), the primary transfer rollers 5 other than the primary transfer roller 5 of the image forming portion 1 (the image forming portion 1*d* for black in this embodiment) are separated (spaced) from the intermediary transfer belt 20. The primary transfer roller 5 is rotated with movement of the intermediary transfer belt 20.

To the primary transfer roller 5, the primary transfer voltage source 40 as a primary transfer voltage application means and a primary transfer current detecting portion (primary transfer current detecting circuit) 50 (50*a*, 50*b*, 50*c*, 50*d*) as a primary transfer control detecting means are connected. To the primary transfer roller 5, a primary transfer voltage is applied from the primary transfer voltage source 40. The primary transfer voltage source 40 is capable of selectively applying a positive (−polarity) voltage and a negative (−polarity) voltage to the primary transfer roller 5. The primary transfer current detecting portion 50 detects a current flowing through the primary transfer roller 5 (primary transfer portion T1, primary transfer voltage source 40) when the primary transfer voltage source 40 applies a voltage to the primary transfer roller 5 (primary transfer portion T1). The primary transfer current detecting portion 50 is capable of outputting a signal showing a detection result of the current to an engine controller 302 (FIG. 2) described later. Further, in this embodiment, the primary transfer voltage source 40 is capable of subjecting the primary transfer roller 5 to constant-current control and constant-voltage control of the voltage applied to the primary transfer roller 5. That is, the primary transfer voltage source 40 is capable of carrying out the constant-current control of the voltage applied to the primary transfer roller 5 by adjusting output of the voltage so that the current detected by the primary transfer current detecting portion 50 becomes substantially constant (approaches a target current value). Further, the primary transfer voltage source 40 is capable of carrying out the constant-voltage control of the voltage applied to the primary transfer roller 5 by adjusting the output of the voltage so as to become substantially constant (so as to approach a target voltage value). The primary transfer voltage source 40 may include, as a primary transfer voltage detecting means, a primary transfer voltage detecting portion (primary transfer voltage detecting circuit) for detecting the voltage applied to the primary transfer roller 5 or may also be capable of detecting the voltage value from a set value of the output voltage. The primary transfer voltage source 40 is capable of outputting a signal showing a detection result of the voltage to the engine controller 302 (described later).

As the secondary transfer roller 24, for example, an elastic roller provided with a layer (elastic layer) of an elastic member such as a sponge rubber is provided. In this embodiment, as the secondary transfer roller 24, an elastic roller is prepared by coating a 6 mm-thick NBR hydrin rubber on a nickel-plated steel rod of 6 mm in diameter. An electric resistance value of the secondary transfer roller 24 in this embodiment is $3.0\times10^{7}\Omega$ in the case where a voltage of 1000 V is applied to an aluminum cylinder in a state in which the secondary transfer roller 24 is pressed against the aluminum cylinder at a pressure of 9.8 N and in which the aluminum cylinder is rotated at a peripheral speed of 50 mm/sec. Further, the secondary transfer roller 24 contacts the intermediary transfer belt 20 toward the secondary transfer opposite roller 23, so that the secondary transfer portion T2 is formed at the contact portion between the intermediary transfer belt 20 and the secondary transfer roller 24. The secondary transfer roller 24 is rotated with movement of the intermediary transfer belt 20 or the recording material P.

To the secondary transfer roller 24, the secondary transfer voltage source 44 as a secondary transfer voltage application means and a secondary transfer current detecting portion (secondary transfer current detecting circuit) 54 as a primary transfer control detecting means are connected. To the secondary transfer roller 24, a secondary transfer voltage is applied from the secondary transfer voltage source 44. The secondary transfer voltage source 44 is capable of selectively applying a positive (−polarity) voltage and a negative (−polarity) voltage to the secondary transfer roller 24. The secondary transfer current detecting portion 54 detects a current flowing through the secondary transfer roller 24 (secondary transfer portion T1, secondary transfer voltage source 40) when the secondary transfer voltage source 40 applies a voltage to the secondary transfer roller 24 (secondary transfer portion T1). The secondary transfer current detecting portion 54 is capable of outputting a signal showing a detection result of the current to the engine controller 302 (described later). Further, in this embodiment, the secondary transfer voltage source 44 is capable of subjecting the secondary transfer roller 24 to constant-current control and constant-voltage control of the voltage applied to the secondary transfer roller 24. That is, the secondary transfer voltage source 44 is capable of carrying out the constant-current control of the voltage applied to the secondary transfer roller 24 by adjusting output of the voltage so that the current detected by the secondary transfer current detecting portion 54 becomes substantially constant (approaches a target current value). Further, the secondary transfer voltage source 44 is capable of carrying out the constant-voltage control of the voltage applied to the secondary transfer roller 24 by adjusting the output of the voltage so as to become substantially constant (so as to approach a target voltage value). The secondary transfer voltage source 44 may include, as a secondary transfer voltage detecting means, a secondary transfer voltage detecting portion (secondary transfer voltage detecting circuit) for detecting the voltage applied to the secondary transfer roller 24 or may also be capable of detecting the voltage value from a set value of the output voltage. The secondary transfer voltage source 44 is capable of outputting a signal showing a detection result of the voltage to the engine controller 302 (described later).

Incidentally, in this embodiment, the secondary transfer opposite roller 23 is electrically grounded.

(3) Printing Mode

In this embodiment, the image forming apparatus 10 is operable in, as a printing mode (image forming mode), the full-color image mode and the monochromatic mode (black (single color) mode in this embodiment). In the full-color image mode, images are formed in all four image forming portions 1*a* to 1*d*, so that a full-color image can be formed. In this embodiment, in the monochromatic mode, an image is formed only in the image forming portion 1*d* for black of the four image forming portions 1*a* to 1*d*, so that a black (single color) image can be formed. In the monochromatic mode, in the image forming portions 1*a* to 1*c* other than the image forming portion 1*d* for forming the black image, the primary transfer rollers 5 are separated from the intermediary transfer belt 20, so that the intermediary transfer belt 20 is spaced from the photosensitive drums 2. Further, in the monochromatic mode, in the image forming portions 1*a* to 1*c* other than the image forming portion 1*d* for black, drive of the photosensitive drums 2 and the developing rollers 8 is stopped and the developing rollers 8 are spaced from the photosensitive drum 1. Incidentally, in the monochromatic mode, in the image forming portions 1*a* to 1*c* other than the image forming portion 1*d*, the primary transfer voltage source 40 does not apply the voltage to the primary transfer roller 5.

The image forming apparatus 10 includes a primary transfer roller moving mechanism (not shown) for moving the primary transfer rollers 5 of the first to third image forming portions 1*a* to 1*c* for switching contact and separation states between the intermediary transfer belt 20 and the photosensitive drums 2 in the full-color image and the monochromatic mode. The primary transfer roller moving mechanism is constituted so that the primary transfer roller 5 can be moved toward and away from the corresponding photosensitive drum 2. Further, the primary transfer roller moving mechanism moves the primary transfer roller 5 toward the photosensitive drum 2, so that the intermediary transfer belt 20 is pressed by the primary transfer roller 5 and thus can be contacted to the photosensitive drum 2. Further, the primary transfer roller moving mechanism moves the primary transfer roller 5 away from the photosensitive drum 2, so that the primary transfer roller 5 is separated from the intermediary transfer belt 20 and thus the intermediary transfer belt 20 can be spaced from the photosensitive drum 2. Incidentally, for example, a primary transfer roller moving mechanism similar to the above-described primary transfer roller moving mechanism may also be provided for the image forming portion 1*d* for black in order to separate (space) the intermediary transfer belt 20 from the photosensitive drums 2 in all the image forming portions 1 in the case where the image forming apparatus 10 is on stand-by for a printing job or in the like case.

Further, the image forming apparatus 10 includes a developing device moving mechanism (not shown) for moving the developing devices 4 of the first to third image forming portions 1*a* to 1*c* for switching contact and separation states between the photosensitive drums 2 and the developing devices 4 in the full-color image and the monochromatic mode. The developing device moving mechanism is constituted so that the developing roller 8 can be moved toward and away from the corresponding photosensitive drum 2 by rotating (swinging) the developing device 4, for example. Further, the developing device moving mechanism moves the developing roller 8 of the developing device 4 used for development toward the photosensitive drum 2, so that the developing roller 8 can be contacted to the photosensitive drum 2. Further, the developing device moving mechanism moves the developing rollers 8, of the developing devices 4 which are not used for development, away from the photosensitive drum 2, so that the developing rollers 8 can be spaced from the photosensitive drum 2. Incidentally, for example, a developing device moving mechanism similar to the above-described developing device moving mechanism may also be provided for the image forming portion 1*d* for black in order to separate (space) the developing rollers 8 from the photosensitive drums 2 in all the image forming portions 1 in the case where the image forming apparatus 10 is on stand-by for a printing job or in the like case. Further, each of the developing rollers 8 may also be constituted so as to be disposed close to the corresponding photosensitive drum 2 without contacting the photosensitive drum 2 during a developing step.

(4) Control Mode

Figure 2:
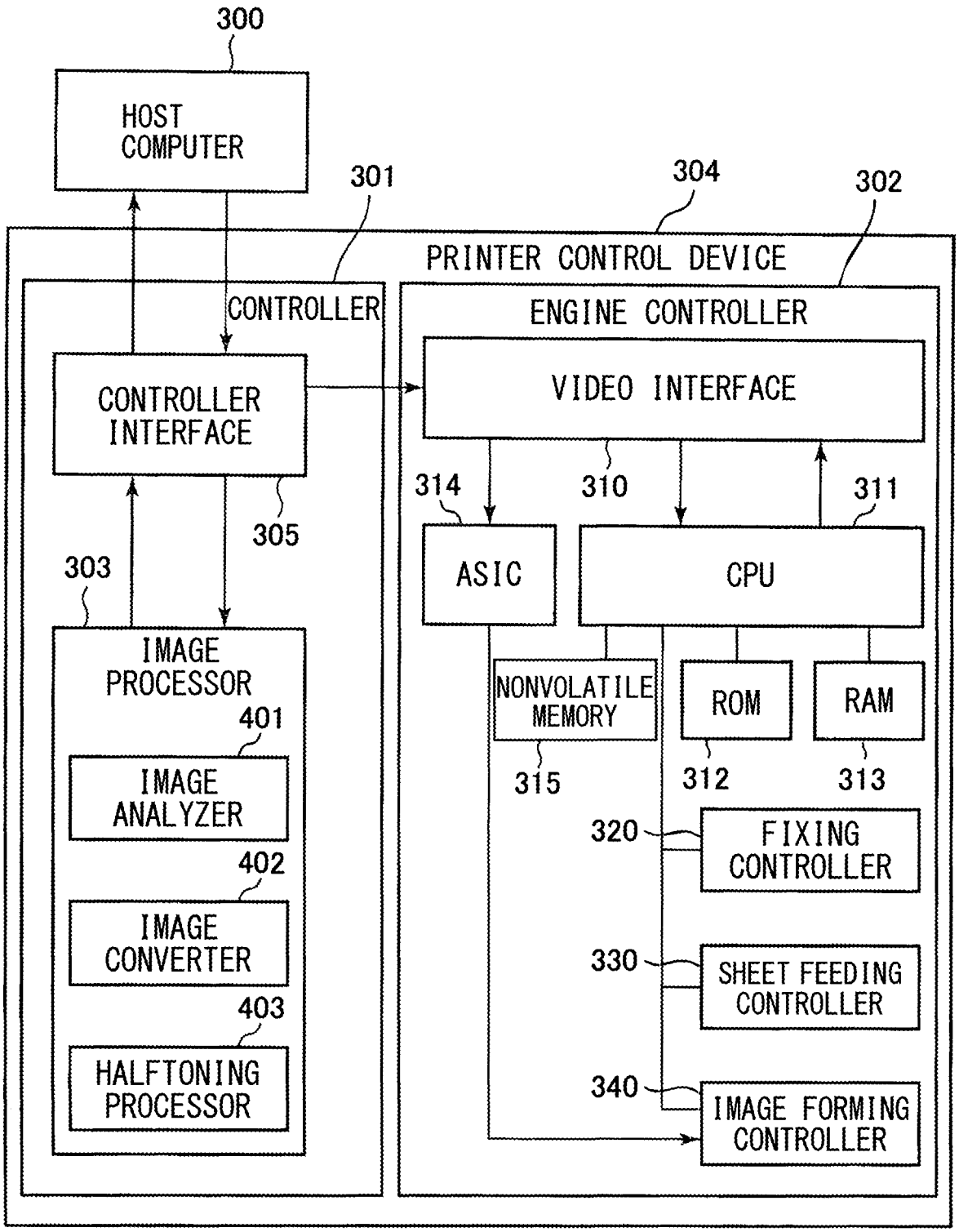
FIG. 2 is a schematic block diagram showing a control mode of a principal part of the image forming apparatus.

FIG. 2 is a schematic block diagram showing a system constitution of the image forming apparatus 10 of this embodiment. The image forming apparatus 10 includes a printer control device 304. The printer control device 304 roughly includes a controller 301 and the engine controller 302. The printer control device 304 is connected to the host computer 300 which is an external device by using a controller interface 305 of the controller 301, and establishes communication with the host computer 300. In the controller 301, on the basis of information received from the host computer 300, an image processor 303 performs bit mapping of character code and half-toning (processing) of a gray-scale image. Further, the controller 301 sends image information to the engine controller 302 through a video interface 310. This image information contains information for controlling turning-on timing of the exposure device 7, information on the printing mode (including recording material information described later) for controlling a process condition such as a control temperature of the fixing device 12, a transfer voltage, image size information, and the like.

The turning-on timing information of the exposure device 7 is sent from the controller 301 to the ASIC (application specific integrated circuit) 314. The ASIC 314 controls a part of the image forming portion 1, such as the exposure device 7, controlled by an image forming controller 340.

On the other hand, pieces of information such as the information on the printing mode and the image size information are sent to a CPU (central processing unit) 311 as a control means. The CPU 311 carries out heating control of the fixing device 12 at a fixing controller 320, operation interval control of the feeding roller 14 at a sheet feeding controller 330, and control of the process speed, development/charging/transfer at the image forming controller 340. In such control, as desired, the CPU 311 stores the information in a RAM 313 as a storing means, uses programs stored in a ROM 312 and the RAM 313 which are storing means, and makes reference to information (a calculation result, detection results of various sensors, and the like) stored in the ROM 312 or the RAM 313. Further, the engine controller 302 is provided with a nonvolatile memory 315 as a storing means for storing an integrated value of a primary transfer current, an integrated value of a secondary transfer current which are described later, and the like.

Further, depending on an instruction inputted on the basis of an operation performed on the host computer 300 by an operator such as a user or a service person, the controller 301 sends a printing instruction, a cancel instruction, and the like to the engine controller 302 and thus controls operations such as a start, a stop, and the like of a printing operation (image forming operation, printing operation).

Here, the image forming apparatus 10 performs a printing job which is a series of image forming operations which is started by a start instruction and in which an image is formed on a single or a plurality of recording materials P and then is outputted. The printing job generally includes an image forming step, a pre-rotation step, a sheet interval step in the case where the image is formed on the plurality of the recording materials P, and a post-rotation step. The image forming step is a period in which formation of the electrostatic (latent) image for an image formed and outputted on the recording material P, formation of the toner image, and primary transfer and secondary transfer of the toner image are performed, and "during image formation" refers to this period. Specifically, timing during the image formation is different at positions where the respective steps including the formation of the electrostatic image, the formation of the toner image, and the primary transfer and the secondary transfer of the toner image are performed, and corresponds to a period in which an image region on the photosensitive drum 2 or the intermediary transfer belt 20 passes through an associated one of the above-described positions. The pre-rotation step is a period in which a preparatory operation, from input of the start instruction until the image formation is actually started, before the image forming step is performed. The sheet interval step is a period corresponding to an interval between a recording material P and a subsequent recording material P when image formation on a plurality of recording materials P is continuously performed (continuous image formation) with respect to the plurality of recording material P. The post-rotation step is a period in which a post-operation (preparatory operation) after the image forming step is performed. "During non-image formation" refers to a period other than "during image formation", and includes the pre-rotation step, the sheet interval step, the post-rotation step and further includes a pre-multi-rotation step which is a preparatory operation during main switch actuation of the image forming apparatus 10 or during restoration from a sleep state. Specifically, timing of during non-image formation corresponds to a period in which a non-image region started on the photosensitive drum 2 or the intermediary transfer belt 20 passes through an associated one of positions where steps of secondary transfer, such as formation of the electrostatic image, formation of the toner image, primary transfer of the toner image and secondary transfer of the toner image, which are described above are carried out. Incidentally, the image region on the photosensitive drum 2 or the intermediary transfer belt 20 refers to a region where the image transferred on the recording material P and outputted from the image forming apparatus 10, and the non-image region refers to a region other than the image region.

(5) Control Method of Secondary Transfer Voltage

Next, a control method of the secondary transfer voltage in this embodiment will be described.

<Outline>

In this embodiment, in order to secondary-transfer the toner image from the intermediary transfer belt 20 onto the recording material P, a secondary transfer voltage of a positive polarity is applied from the secondary transfer voltage source 44 to the secondary transfer roller 24. In this embodiment, the secondary transfer voltage applied to the secondary transfer roller 24 in a secondary transfer step is subjected to constant-current control so that a current value detected by the secondary transfer current detecting portion 54 becomes a predetermined secondary transfer target current value Iref(T2).

As regards the secondary transfer target current value is Iref(T2), a target current value is determined in advance so as to obtain an optimum transfer property depending on environment information which is information on an environment (at least one of a temperature and a humidity), recording material information which is information on a kind of the recording material P, information on the printing mode, and the like information.

That is, in the ROM 312, information on the secondary transfer target current value determined in advance depending on the environmental information, the recording material information, the printing mode information, or the like information is stored. Further, the image forming apparatus 10 is provided with an environmental sensor (not shown) constituted by, for example, a temperature/humidity sensor as an environment detecting means for detecting at least one of the temperature and the humidity of at least one of an inside and an outside of the image forming apparatus 10. The CPU 311 is capable of acquiring the environmental information from this environmental sensor. Further, the CPU 311 is capable of acquiring the recording material information contained in the printing job information inputted from the host computer 300 through the controller 301. Incidentally, the information (recording material information) on the kind of the recording material P embraces arbitrary information capable of discriminating the recording material P, such as attributes (so-called paper kind categories) based on general features inclusive of plain paper, glossy paper, coated paper, embossed paper, thick paper, thin paper and the like, numerals or numerical ranges inclusive of a basis weight, a thickness, a size, and the like, and brands (inclusive of manufactures and product numbers). Further, the CPU 311 is capable of acquiring information on the printing mode (full-color image, monochromatic mode, and the like) contained in the printing job inputted from the host computer 300 through the controller 301. Accordingly, on the basis of the above-acquired pieces of information such as the environmental information, the recording material information, and the printing mode information, the CPU 311 is capable of selecting a corresponding value from the secondary transfer target current values determined in advance and stored in the ROM 312.

Incidentally, this secondary transfer target current value Iref(T2) is determined depending on the environmental information, the recording material information, the printing mode information, and the like in the above-described manner before the secondary transfer step of the toner image on the recording material P is executed. For example, the secondary transfer target current value Iref(T2) may be determined in the pre-rotation operation before the image formation when the printing job is started and may also be determined in the pre-rotation operation or in the sheet interval operation before the secondary transfer step of the toner image on each of the recording materials P.

One of features of this embodiment is that in the secondary transfer step, the secondary transfer target current value is changed depending on the image information of the image to be secondary-transferred onto the recording material P without being fixed to the secondary transfer target current value Iref(T2) determined in advance. Further, another one of the features of this embodiment is that a change amount of the secondary transfer target current value is changed on the basis of a balance of an amount of a current flowing through the intermediary transfer belt 20.

Control of the secondary transfer voltage in this embodiment is roughly classified into "determination of target current value change region S(T2)" and "determination of change amount of target current value".

<Determination of Target Current Value Change Region S(T2)>

First, "determination of target current value change region S(T2)" will be described.

(Principal of Determination of Target Value Change Region S(T2))

In this embodiment, a region where an image defect, in the image secondary-transferred on the recording material P, of a level which cannot be allowed even when the secondary transfer target current value is changed is determined as the target current value change region S(T2).

That is, as described above, the secondary transfer target current value is determined in advance so that the optimum transfer property can be obtained depending on the environmental information, the recording material information, the printing mode information, or the like. Accordingly, a change in secondary transfer target current value in the secondary transfer step under the same condition that the environmental information, the recording material information, the printing mode information, and the like are the same means that the secondary transfer target current value is deviated from the optimum value at which an optimum transfer property is obtained. For example, in the case where the secondary transfer target current value is changed from the secondary transfer target current value determined in advance to a lower secondary transfer target current value, there is a possibility that in a solid image, image defect such as a lowering in density with a lowering in transfer efficiency occurs. On the other hand, in the case where the secondary transfer target current value is changed from the secondary transfer target current value determined in advance to a higher secondary transfer target current value, there is a possibility that image defect due to electric discharge occurs by an electric discharge phenomenon due to an excessive potential difference. For that reason, when the secondary transfer target current value is changed simply, a risk of occurrence of the above-described image defect increases. Therefore, in this embodiment, the "determination of target current change region S(T2)" depending on the image information of the image to be secondary-transferred onto the recording material P is made, and then the secondary transfer target current value is changed in a region where the risk that the above-described image defect occurs is small.

In the case where the image secondary-transferred onto the recording material P is not a solid image or a half-tone image but is an image with a low coverage, it has been known that the image defect as described above is not readily visualized. Here, a "coverage" refers to a ratio occupied by an image region (image portion, portion on which toner is placed) per unit area. As regards the image information, discrimination is made depending on whether or not the image exists irrespective of a color of the image, and a region where the image exists is referred to as an image region. In this embodiment, the above-described predetermined area (unit block) is a region of 24 pixels (main scan direction)×24 pixels (sub-scan direction). Incidentally, the main scan direction (of the exposure device 7) is a direction substantially parallel to a rotational axis of the photosensitive drum 2 and corresponds to a direction substantially perpendicular to feeding directions of the intermediary transfer belt 20 and the recording material P. Further, the sub-scan direction is a direction substantially perpendicular to the main scan direction and corresponds to a direction substantially parallel to the feeding directions of the intermediary transfer belt 20 and the recording material P. As an example, in the case where the image region is 288 pixels of 24 pixels×24 pixels (total pixel number=576), the coverage is 50%.

For example, in the case where the secondary transfer target current value is changed from the secondary transfer target current value determined in advance to a lower secondary transfer target current value, as regards the image with the low coverage, a toner amount of the toner to be transferred, i.e., a total charge amount of the toner to be transferred is smaller than the amount for the solid image, and therefore, transfer efficiency does not readily lower, so that a transfer property is maintained. On the other hand, also, in the case where the secondary transfer target current value is changed from the secondary transfer target current value determined in advance to a higher secondary transfer target current value, as regards the image with the low coverage, a toner amount of the toner disturbed by the electric discharge is small, and therefore, the image is not readily visualized as the image defect.

Thus, as regards the image with the low coverage, compared with the solid image and the half-tone image, a risk of an occurrence of the image defect with the change in secondary transfer target current value becomes small. As described later, by setting a change amount of the secondary transfer target current value at a range in which the image defect does not occur in the image with the low coverage, it becomes possible to prevent the image defect from occurring even when the secondary transfer target current value is changed.

For the above-described reasons, in this embodiment, on the basis of the image information of the image to be transferred onto the recording material P, the "determination of target current value change region S(T2)" in which a region where the secondary transfer target current value is changeable and a region where it is desirable that the secondary transfer target current value is not changed are selected.

(Determining Method of Target Current Value Change Region S(T2))

Next, a specific method of the "determination of target current value change region S(T2)" will be described.

As shown in FIG. 2, the image processor 303 includes an image analyzer 401, an image converter 402, and a half-toning processor 403. The image analyzer 401 makes the "determination of target current value change region S(T2)" by analyzing the image as specifically described later. The image converter 402 performs image conversion of a character code, and the half-toning processor 403 performs half-toning (processing) of a gray-scale image, so that bit mapping of the image is carried out.

In this embodiment, processing by the image converter 402 is performed in resolution of 600 dpi. Further, in this embodiment, the order of calculation processing by the image analyzer 401 is such that the calculation processing is performed with respect to image data after the processing by the image converter 402 is ended and before the processing by the half-toning processor 403 is performed. However, the order of image processing is not limited thereto, but can be appropriately selected.

(Processing Method of Determination of Target Current Value Change Region S(T2))

Next, a processing method of the "detection of target current value change region S(T2)" by the image analyzer 401 will be described.

First, the image analyzer 401 divides an original image (600 dpi) into unit blocks of 24 pixels×24 pixels (total pixel number=576). Next, the image analyzer 401 calculates a coverage in each of all the unit blocks and then discriminates whether or not the coverage in each unit block is smaller than a predetermined threshold. In the case where a ratio occupied by the image region in the unit block is the threshold or more, the image analyzing portion 401 discriminates that the unit block is a non-low coverage block. On the other hand, in the case where the ratio occupied by the image region in the unit block is less than the threshold, the image analyzing portion 401 discriminates that the unit block is a low coverage block. In this embodiment, the threshold of the coverage is set at 30%. Parts (a) and (b) of FIG. 3 show examples of the ratio occupied by the image region in the unit block. As shown in part (a) of FIG. 3, in the case where the ratio occupied by the image region in the unit block is 30% or more, the image analyzer 401 discriminates that the unit block is the non-low coverage block. On the other hand, as shown in part (b) of FIG. 3, in the case where the ratio occupied by the image region in the unit block is less than 30%, the image analyzer 401 discriminates that the unit block is the low coverage block.

Next, the image analyzer 401 determines the target current value change region S(T2) on the basis of a calculation result of the coverage of each unit block. As an example, FIG. 4 shows a region on the recording material P on which an image including the low-coverage block and the low coverage blocks in mixture is transferred.

The image analyzer 401 determines, along the sub-scan direction, whether or not the region on the recording material P is the target current value change region S(T2). In this embodiment, the image analyzer 401 determines a "region where all the unit blocks are low coverage blocks or marginal portions along the main scan direction" as the target current value change region S(T2). Here, the "marginal portion" includes a non-image formation region which is a region other than an image formation region where the toner image is capable of being transferred onto the recording material P, a solid white portion in the image formation portion on the recording material P, and a region of a dot pattern with a low coverage, such as electronic (digital) watermark (security pattern watermark) in the image formation region on the recording material P. That is, the "marginal portion" includes a portion where there is image information but the coverage is less than the threshold (i.e., a portion where there is no image and the coverage is 0%), and a portion where there is no image information. In this embodiment, the above-described "region where all the unit blocks are low coverage blocks or marginal portions along the main scan direction" is also referred to as a "low coverage region" since in either case, the region is a region where a ratio occupied by an image region per unit area is less than the threshold. That is, in this embodiment, the image analyzer 401 determines the low coverage region on the recording material P as the target current value change region S(T2).

For example, in FIG. 4, a region A and a region E are marginal portions. In these regions, image defect does not occur even when the secondary transfer target current value is changed. For that reason, the region A and the region E can be used as the target current value change region S(T2). Further, in FIG. 4, a region B is a region including the non-low coverage region and the low coverage region in mixture along the main scan direction. In this region, in the case where the secondary transfer target current value is changed, although there is no problem in the low coverage block region, there is a possibility of an occurrence of the image defect in the non-low coverage block region. For that reason, the region B cannot be used as the target current value change region S(T2). Further, in FIG. 4, a region C is a region where entirety thereof is the non-low coverage block along the main scan direction. For this reason, the region C cannot be used as the target current value change region S(T2). Further, in FIG. 4, a region D is a region where entirety thereof is the low coverage block along the main scan direction. For that reason, the region D can be used as the target current value change region S(T2). Thus, in the case of the image shown in FIG. 4, the image analyzer 401 determines, as the target current value change region S(T2), the regions A, D and E which are regions where all the unit blocks are the low coverage blocks or the marginal portions (i.e., the low coverage regions).

<Determination of Change Amount of Target Current Value>

Next, "determination of change amount of target current value" will be described.

(Determining Method of Change Amount of Target Current Value)

In this embodiment, the change amount of the secondary transfer target current value in the target current value change region S(T2) is determined so as to achieve the balance of the current flowing through the intermediary transfer belt 20. By this, the maldistribution (dissociation or maldistribution) of the ion conductive agent in the intermediary transfer belt 20 is suppressed, so that it becomes possible to suppress bleed out of the ion conductive agent.

In this embodiment, in order to monitor the balance of the amount of the current flowing through the intermediary transfer belt 20, the CPU 311 of the engine controller 302 calculates an integrated value of the primary transfer current and an integrated value of the secondary transfer current in real time and causes the nonvolatile memory 315 (FIG. 2) to store the values. Specifically, the CPU 311 integrates current detection results of primary transfer current detecting portions 50*a* to 50*d* in real time every 100 msec from a start of an operation of the image forming apparatus 10 and causes the nonvolatile memory 315 to store the integrated value as Isum(T1). Further, the CPU 311 integrates a current detection result of the secondary transfer current detecting portion 54 in real time every 100 msec from the start of the operation of the image forming apparatus 10 and causes the nonvolatile memory 315 to store the integrated value as Isum(T2). That is, the nonvolatile memory 315 is provided with storing areas for storing Isum(T1) and Isum(T2), respectively. Incidentally, a timing when the operation of the image forming apparatus 10 is started is typically a timing when a main switch of the image forming apparatus 10 is turned on or when restoration from a sleep state of the image forming apparatus 10 is instructed.

For example, in the case where each of the primary transfer current detecting portions 50*a* to 50*d* acquires a current detection result of +10 μA for 5 sec, Isum(T1) is 2000. Thereafter, in the case where for 2 sec, each of the primary transfer current detecting portions 50*a* to 50*d* acquires a current detection result of −5 μA, Isum(T1) is renewed to 1600. Similarly, in the case where the secondary transfer current detecting portion 54 acquires a current detection result of +20 μA for 5 sec, Isum(T2) is 1000. Thereafter, in the case where for 2 sec, the secondary transfer current detecting portion 54 acquires a current detection result of −10 μA, Isum(T2) is renewed to 800.

Here, Isum(T1) shows a sum of amounts of the current flowing through the intermediary transfer belt 20 from an inner peripheral surface side to an outer peripheral surface side. Further, Isum(T2) shows a sum of amounts of the output flowing through the intermediary transfer belt 20 from the outer peripheral surface side to the inner peripheral surface side. For this reason, on the basis of Isum(T1) and Isum(T2), the ratio of the amounts of the current flowing through the intermediary transfer belt 20 is calculated, so that it is possible to predict a degree of maldistribution of the ion conductive agent in the intermediary transfer belt 20.

For example, in the case where Isum(T1) is larger than Isum(T2), the amount of the current flowing through the intermediary transfer belt 20 from the inner peripheral surface side to the outer peripheral surface side is large, and therefore, it suggests that a cationic electroconductive agent causes maldistribution on the outer peripheral surface side of the intermediary transfer belt 20. On the other hand, in the case where Isum(T1) is smaller than Isum(T2), the amount of the current flowing through the intermediary transfer belt 20 from the outer peripheral surface side to the inner peripheral surface side is large, and therefore, it suggests that an anionic electroconductive agent causes maldistribution on the outer peripheral surface side of the intermediary transfer belt 20. Further, with an increasing difference between Isum(T1) and Isum(T2), a larger degree of the maldistribution of the ion conductive agent is suggested.

Incidentally, in order to properly grasp the degree of the maldistribution of the ion conductive agent in the intermediary transfer belt 20, it is preferable that Isum(T1) and Isum(T2) are integrated and renewed in real time also during operation of the image forming apparatus 10 other than the image formation. As the operation other than the image formation, it is possible to cite the pre-rotation operation, the sheet interval operation, the post-rotation operation, and a special operation such as calibration. Further, it is preferable that Isum(T1) and Isum(T2) are stored in the nonvolatile memory or the like and then are renewed without being reset in a sleep state after an end of the printing job or in a state in which the main switch of the image forming apparatus 10 is turned off. Incidentally, when the intermediary transfer belt unit or the intermediary transfer belt 20 is exchanged, Isum(T1) and Isum(T2) may also be reset to an initial value (typically zero).

(Procedure for Determining Change Amount of Secondary Transfer Target Current Value)

Next, a procedure for determining the change amount of the secondary transfer target current value in the target current value change region S(T2) on the basis of Isum(T1) and Isum(T2) will be described. FIG. 5 is a flowchart showing an outline of this procedure. Incidentally, the target current value change region S(T2) is also simply referred to as a "region S(T2)".

The CPU 311 starts the printing job when it receives a signal of the printing job, and discriminates whether or not the region S(T2) exists in the image to be secondary-transferred onto the recording material P when the secondary transfer step in the image forming operation is performed (S101). This discrimination is made, for every image to be secondary transferred onto a single recording material P, on the basis of information on a result of the "determination of target current value change region S(T2)" acquired from the image analyzer 401. On the basis of information received from the host computer 300, for every image to be secondary-transferred onto the single recording material P, the image analyzer 401 makes the "determination of the target current value change region S(T2)" as described above, and then sends information on a result thereof to the CPU 311. The CPU 311 is capable of causing the RAM 313 as needed to store, in the RAM 313, this information received from the image analyzer 401 and is capable of reading the information from the RAM 313 and is capable of using the information.

In the case where the CPU 311 discriminated in S101 that the region S(T2) does not exist, the CPU 311 keeps the secondary transfer target current value at the secondary transfer target current value Iref(T2) determined in advance depending on the environment information, the recording material information, the printing mode information, or the like (S106).

On the other hand, in the case where the CPU 311 discriminated in S101 that the region S(T2) exists, the CPU 311 discriminates the secondary transfer target current value in the region S(T2) on the basis of the balance of the amounts of the current flowing through the intermediary transfer belt 20. First, on the basis of Isum(T1) and Isum(T2) read from the nonvolatile memory 315, the CPU 311 discriminates whether or not Isum(T1) and Isum(T2) are substantially equal to each other (S102). Incidentally, in this embodiment, whether or not Isum(T1) and Isum(T2) are substantially equal to each other is discriminated, but whether or not a difference between Isum(T1) and Isum(T2) is less than a predetermined threshold (typically whether or not the difference is substantially zero as in this embodiment) may also be discriminated.

In the case where the CPU 311 discriminated in S102 that Isum(T1) and Isum(T2) are the same value, the CPU 311 keeps the secondary transfer target current value in the region S(T2) at the secondary transfer target current value Iref(T2) determined in advance (S106). This is because a state in this case can be discriminated as a state in which there is no bias of the balance of amounts of the current flowing through the intermediary transfer belt 20. Incidentally, also, as regards the secondary transfer target current value in a region other than the region S(T2), the secondary transfer target current value is kept at the secondary transfer target current value Iref(T2) determined in advance.

Further, in the case where the CPU 311 discriminated in S102 that Isum(T1) and Isum(T2) are not the same value (in the case where there is a difference between Isum(T1) and Isum(T2), the CPU 311 discriminates whether or not Isum (T1) is larger than Isum(T2) (S103). This is because depending on a magnitude relationship between Isum(T1) and Isum(T2), the secondary transfer target current value in the region S(T2) is changed from the secondary transfer target current value Iref(T2) determined in advance.

In the case where the CPU 311 discriminated in S103 that Isum(T1) is larger than Isum(T2), the CPU 311 sets the secondary transfer target current value in the region S(T2) at a value higher than the secondary transfer target current value Iref(T2) determined in advance (S104). This is because in this case, it is possible to discriminate that the cationic electroconductive agent causes maldistribution on the outer peripheral surface side of the intermediary transfer belt 20, and therefore, this maldistribution of the ion conductive agent is suppressed. In this embodiment, the secondary transfer target current value in the region S(T2) is changed to Iref(T2)+7 μA. Incidentally, the secondary transfer target current value in a region other than the region S(T2) is kept at the secondary transfer target current value Iref(T2). For example, in the case of the image shown in FIG. 4, in the regions B and C, the secondary transfer target current value is kept at Iref(T2) and is subjected to constant-current control, and in the regions A, D and E, the secondary transfer target current value is changed to Iref(T2)+7 μA and is subjected to constant-current control.

On the other hand, the case where the CPU 311 discriminated in S103 that Isum(T1) is smaller than Isum(T2), the CPU 311 sets the secondary transfer target current value in the region S(T2) at a value lower than the secondary transfer target current value Iref(T2) determined in advance (S105). This is because in this case, it is possible to discriminate that the anionic electroconductive agent causes maldistribution on the outer peripheral surface side of the intermediary transfer belt 20, and therefore, this maldistribution of the ion conductive agent is suppressed. In this embodiment, the secondary transfer target current value in the region S(T2) is changed to Iref(T2)−7 μA. Incidentally, the secondary transfer target current value in a region other than the region S(T2) is kept at the secondary transfer target current value Iref(T2). For example, in the case of the image shown in FIG. 4, in the regions B and C, the secondary transfer target current value is kept at Iref(T2) and is subjected to constant-current control, and in the regions A, D and E, the secondary transfer target current value is changed to Iref(T2)−7 μA and is subjected to constant-current control.

Then, the CPU 311 performs the secondary transfer step for every one recording material P at the secondary transfer target current value determined as described above.

Thus, in this embodiment, on the basis of the balance of the amounts of the current flowing through the intermediary transfer belt 20, by changing the secondary transfer target current value in the region S(T2), it becomes possible to suppress the maldistribution of the ion conductive agent in the intermediary transfer belt 20 during image formation.

<Difference in Change Amount of Secondary Transfer Target Current Value Depending on Printing Mode>

Parts (a) and (b) of FIG. 6 are schematic views of a portion around the intermediary transfer belt 20 for illustrating a difference in change amount of the secondary transfer target current value depending on the printing mode, in which part (a) shows the case of an operation in the full-color image, and part (b) shows the case of an operation in the monochromatic mode (black (single color) mode).

In the operation in the full-color image, as shown in part (a) of FIG. 6, all the four primary transfer rollers 5*a* to 5*d* contact the intermediary transfer belt 20. For that reason, an integrated amount Isum(T1) of the amount of the current flowing through the intermediary transfer belt 20 at the primary transfer portion T1 in the operation in the full-color image is larger than that in the operation in the monochromatic mode. In this embodiment, for example, the secondary transfer target current value Iref(T2) detected in advance under condition that a temperature is 23° C., a relative humidity is 50% RH, the recording material P is plain paper and the printing mode is a full-color normal printing mode is 30 μA. Incidentally, the full-color normal printing mode is an example of the full-color image selected in the case the plain paper is used as the recording material P. For example, in order to meet the case where thick paper is used as the recording material P, the image forming apparatus 10 may also be operable in another full-color image mode different in process condition such as a process speed from the above-described full-color normal printing mode. Further, in the condition, in the primary transfer step, the primary transfer voltage is subjected to constant-voltage control at a primary transfer voltage value corresponding to 15 μA which is the primary transfer target current value Iref(T1). That is, in this embodiment, in the pre-rotation operation before the image formation, constant-output control of the voltage applied from each of the primary transfer voltage sources 40*a* to 40*d* to the corresponding one of the primary transfer rollers 5*a* to 5*d* is carried out so that a current value detected by the corresponding one of the primary transfer current detecting portions 50*a* to 50*d* is 15 μA which is the primary transfer target current value Iref(T1). Further, in the primary transfer step, a primary transfer voltage applied from each of the primary transfer voltage sources 40*a* to 40*d* to the corresponding one of the primary transfer rollers 5*a* to 5*d* is subjected to constant-voltage control in which the voltage value detected during the above-described constant-current control is used as a target voltage value (primary transfer voltage value Vref(T1)).

The current value detected during the above-described constant-current control somewhat fluctuates, but for simplification, it is assumed that a time-average value of each of detection results of the primary transfer current detecting portions 50*a* to 50*d* is 15 μA and that a time-average value of a detection result of the secondary transfer current detecting portion 54 is 30 μA.

In such a condition, in the case where continuous printing is repeated, 60 is incremented to Isum(T1) every 100 msec, whereas 30 is incremented to Isum(T2) every 100 msec, and therefore, Isum(T1) becomes larger than Isum(T2). For that reason, in this embodiment, in the operation in the full-color image, as the secondary transfer target current value in the region S(T2), a value larger than the secondary transfer target current value Iref(T2) determined in advance is selected.

In the operation in the monochromatic mode, as shown in part (b) of FIG. 6, only the primary transfer roller 5*d* for black of the four primary transfer rollers 5*a* to 5*d* contacts the intermediary transfer belt 20. For that reason, an integrated amount Isum(T1) of the amount of the current flowing through the intermediary transfer belt 20 at the primary transfer portion T1 in the operation in the monochromatic mode is smaller than that in the operation in the full-color image.

In this embodiment, for example, the secondary transfer target current value Iref(T2) detected in advance under condition that a temperature is 23° C., a relative humidity is 50% RH, the recording material P is plain paper and the printing mode is a monochromatic normal printing mode is 25 μA. Incidentally, the monochromatic normal printing mode is an example of the monochromatic mode selected in the case the plain paper is used as the recording material P. For example, in order to meet the case where thick paper is used as the recording material P, the image forming apparatus 10 may also be operable in another monochromatic mode different in process condition such as a process speed from the above-described monochromatic normal printing mode. Further, in the condition, in the primary transfer step, the primary transfer voltage is subjected to constant-voltage control at a primary transfer voltage value corresponding to 15 μA which is the primary transfer target current value Iref(T1). Incidentally, a setting method of this primary transfer voltage value is similar to the setting method in the case of the above-described operation in the full-color image. However, in the operation in the monochromatic mode, a setting operation of the primary transfer voltage value by the above-described constant-current control is performed only in the image forming portion 1*d* for black. The reason why the secondary transfer target current value Iref(T2) in the operation in the monochromatic mode is smaller than the value in the operation in the full-color image is as follows. That is, in the operation in the monochromatic mode, the toner primary-transferred onto the intermediary transfer belt 20 is only the black toner, so that the amount of the toner secondary-transferred onto the recording material P is smaller than the amount of the toner in the operation in the full-color image.

The current value detected during the above-described constant-current control somewhat fluctuates, but for simplification, it is assumed that a time-average value of each of detection results of the primary transfer current detecting portions 50*a* to 50*d* is 15 μA and that a time-average value of a detection result of the secondary transfer current detecting portion 54 is 25 μA.

In such a condition, in the case where continuous printing is repeated, 15 is incremented to Isum(T1) every 100 msec, whereas 25 is incremented to Isum(T2) every 100 msec, and therefore, Isum(T1) becomes smaller than Isum(T2). For that reason, in this embodiment, in the operation in the monochromatic mode, as the secondary transfer target current value in the region S(T2), a value smaller than the secondary transfer target current value Iref(T2) determined in advance is selected.

Thus, in this embodiment, by changing the change amount of the secondary transfer target current value in the target current value change region S(T2) between the operations in the full-color image and the monochromatic mode, it becomes possible to properly suppress the maldistribution of the ion conductive agent in the intermediary transfer belt 20 in the operations in both the modes.

(6) Image Output Experiment Result

Next, a result of an image output experiment, between a comparison example and this embodiment, conducted for verifying an effect of this embodiment will be described. The image output experiment was conductive in the operation in the full-color image and in the operation in the monochromatic mode.

<Full-Color Mode>

First, a result of the image output experiment in the operation in the full-color image (mode) will be described.

The comparison example in this image output experiment is an example in which in the secondary transfer step, the secondary transfer target current value is not changed while being kept at the secondary transfer target current value Iref(T2) determined in advance. As the image output experiment, a sheet passing durability test described below is conducted, so that a cleaning performance of the cleaning blade 31 of the cleaning device 32 was compared between the comparison example and this embodiment.

A test environment was 23° C. in temperature and 50% RH in relative humidity. As the recording material P, paper ("GF-0081" (trade name), manufactured by Canon Marketing Japan Inc.) was used. In the operation, as the printing mode, the full-color normal printing mode was employed, and continuous printing was executed. In the operation in this mode, a process speed is 300 mm/sec, and a throughput is 55 sheets per minute. In this condition, Iref(T1) is 15 μA, and Iref(T2) is 30 μA.

As an output image, the following images were used. On half of the recording material P on a leading end side with respect to the feeding direction of the recording material P, an image which has a print ratio of 2% for each of images of yellow, magenta, cyan and black and which has a coverage of 8% in unit block is formed. On half of the recording material P on a trailing end side with respect to the feeding direction of the recording material P, a solid image which has a print ratio of 25% for each of images of yellow, magenta, cyan and black and which has a coverage of 100% in unit block is formed. That is, a ratio (area) occupied by the target current value change region S(T2) in this output image is 50%.

Further, in this sheet passing durability test, an adjusting operation during non-image formation is executed at a predetermined frequency during continuous printing, so that maldistribution of the ion conductive agent in the intermediary transfer belt 20 was corrected. That is, the printing is once interrupted when the printing of a predetermined number of pages is carried out, and the adjusting operation during the non-image formation was executed. As the adjusting operation, the following operation was performed. The intermediary transfer belt 20 is rotated through two full circumferences while applying a voltage of a negative polarity (opposite polarity to the polarity during the image formation) to the four primary transfer rollers 5*a* to 5*d* and applying a voltage of a positive polarity to the secondary transfer roller 24. The voltage of the negative polarity applied to the four primary transfer rollers 5*a* to 5*d* is subjected to constant-current control at a target current value of −10 μA. The voltage of the positive polarity applied to the secondary transfer roller 24 is subjected to constant-current control at a target current value of 40 μA higher than Iref(T2). By executing this adjusting operation, the cationic electroconductive agent having maldistribution on the outer peripheral surface side of the intermediary transfer belt 20 is moved toward the inner peripheral surface side of the intermediary transfer belt 20. Incidentally, a required time per (one) adjusting operation is 5 sec.

Further, as regards the comparison examples, the sheet passing durability test was conducted under two conditions different in execution frequency of the adjusting operation during the non-image formation. The comparison example conducted under the condition in which the adjusting operation is executed once per 50 pages is a comparison example (1), and the comparison example conducted under the condition in which the adjusting operation is executed twice per 50 pages is a comparison example (2). Incidentally, in this embodiment, the adjusting operation is executed once per 50 pages.

Further, sampling of the output image was conducted during the sheet passing durability test, and evaluation was made by observing whether or not improper cleaning occurred on the output image until the printing of 150,000 sheets was ended. An evaluation criterion was that the case where the improper cleaning did not occur is "o (good)" and the case where the improper cleaning occurred is "x (poor)". A result is shown in a table 1. In the table 1, the execution frequency of the adjusting operation, the required time of downtime of the adjusting operation, and presence or absence of the image defect (improper cleaning) during the sheet passing durability test in this embodiment and the comparison examples (1) and (2) are shown.

TABLE 1

(Full-color mode)

| | CE(1)*1 | CE(2)*2 | EMB.1 |
|---|---|---|---|
| EF*3 | ONCE | TWICE | ONCE |
| RT*4 | 5 sec | 10 sec | 5 sec |
| ID*5 | x | ○ | ○ |

*1"CE(1)" is the comparison example (1).
*2"CE(2)" is the comparison example (2).
*3"EF" is the execution frequency (execution number of times) per 50 pages of the adjusting operation during non-image formation.
*4"RT" is the required time (sec) per 50 pages of the downtime with the adjusting operation.
*5"ID" is the presence "○" or absence "x" of the image defect (improper cleaning).

As shown in the table 1, in the comparison example (1), a vertical stripe of improper cleaning extending along the feeding direction of the recording material P occurred on the output image from about timing when the number of sheets printed exceeded 100,000 sheets. When the cleaning blade 31 was observed at a position corresponding to a position where the improper cleaning occurred, deposition of impurities, due to the ion conductive agent which bled out to a free end portion of the blade, on the free end portion was confirmed. That is, in the comparison example (1), it would be considered that the improper cleaning occurred by the ion conductive agent which bled out from the inside of the intermediary transfer belt 20.

In the comparison example (2) in which the execution frequency of the adjusting operation during the non-image formation is increased to twice the execution frequency in the comparison example (1), even when the number of sheets printed reaches 150,000 sheets, the improper cleaning did not occur. In the comparison example (2), the execution frequency of the adjusting operation is high, and therefore, there are many opportunities of rectification of the maldistribution of the ion conductive agent in the intermediary transfer belt 20. For that reason, it would be considered that the bleed out of the ion conductive agent is suppressed and thus the improper cleaning did not occur. However, in the comparison example (2), the required time of the downtime with the adjusting operation is 10 sec per 50 pages which was increased to twice the required time (5 sec) in the comparison example (1).

On the other hand, in this embodiment (embodiment 1), even when the execution frequency of the adjusting operation during the non-image formation was low, the improper cleaning did not occur. In this embodiment, in the secondary transfer step, the secondary transfer target current value in the target current value change region S(T2) is changed from 30 μA which is the secondary transfer target current value Iref(T2), to 37 μA. For that reason, it is possible to suppress the maldistribution of the ion conductive agent in the intermediary transfer belt 20 not only during the non-image formation but also during the image formation. By this, in this embodiment, the execution frequency of the adjusting operation during the non-image formation is suppressed, so that it is possible to suppress the improper cleaning due to the bleed out of the ion conductive agent while suppressing the required time of the downtime.

<Monochromatic Mode>

Next, a result of the image output experiment in the operation in the monochromatic mode will be described.

Similarly as in the image output experiment in the above-described operation in the full-color image, the comparison example in this image output experiment is an example in which in the secondary transfer step, the secondary transfer target current value is not changed while being kept at the secondary transfer target current value Iref(T2) determined in advance. As the image output experiment, a sheet passing durability test described below is conducted, so that a cleaning performance of the cleaning blade 31 of the cleaning device 32 was compared between the comparison example and this embodiment.

A test environment was 23° C. in temperature and 50% RH in relative humidity. As the recording material P, paper ("GF-0081" (trade name), manufactured by Canon Marketing Japan Inc.) was used. In the operation, as the printing mode, the monochromatic normal printing mode was employed, and continuous printing was executed. In the operation in this mode, a process speed is 300 mm/sec, and a throughput is 55 sheets per minute. In this condition, Iref(T1) is 15 μA, and Iref(T2) is 25 μA.

As an output image, the following images were used. On half of the recording material P on a leading end side with respect to the feeding direction of the recording material P, an image (block) with a coverage of 8% in unit block is formed. On half of the recording material P on a trailing end side with respect to the feeding direction of the recording material P, a solid image (black) with a coverage of 100% in unit block is formed. That is, a ratio (area) occupied by the target current value change region S(T2) in this output image is 50%.

Further, in this sheet passing durability test, an adjusting operation during non-image formation is executed at a predetermined frequency during continuous printing, so that maldistribution of the ion conductive agent in the intermediary transfer belt 20 was corrected. As the adjusting operation, the following operation was performed. The intermediary transfer belt 20 is rotated through two full circumferences while applying a voltage of the positive polarity to the primary transfer roller 5*d* for black and applying a voltage of the negative polarity (opposite polarity to the polarity during the image formation) to the secondary transfer roller 24. The voltage of the positive polarity applied to the primary transfer roller 5*d* for black is subjected to constant-current control at a target current value of 25 μA higher than Iref(T1). The voltage of the negative polarity applied to the secondary transfer roller 24 is subjected to constant-current control at a target current value of −10 μA. By executing this adjusting operation, the anionic electroconductive agent caused maldistribution thereof on the outer peripheral surface side of the intermediary transfer belt 20 is moved toward the inner peripheral surface side of the intermediary transfer belt 20. Incidentally, a required time per (one) adjusting operation is 5 sec.

Further, as regards the comparison examples, the sheet passing durability test was conducted under two conditions different in execution frequency of the adjusting operation during the non-image formation. The comparison example conducted under the condition in which the adjusting operation is executed once per 50 pages is a comparison example (1), and the comparison example conducted under the condition in which the adjusting operation is executed twice per 50 pages is a comparison example (2). Incidentally, in this embodiment, the adjusting operation is executed once per 50 pages.

Further, sampling of the output image was conducted during the sheet passing durability test, and evaluation was made by observing whether or not improper cleaning occurred on the output image until the printing of 150,000 sheets was ended. An evaluation criterion was that the case where the improper cleaning did not occur is "o (good)" and the case where the improper cleaning occurred is "x (poor)". A result is shown in a table 2. In the table 2, the execution frequency of the adjusting operation, the required time of downtime of the adjusting operation, and presence or absence of the image defect (improper cleaning) during the sheet passing durability test in this embodiment and the comparison examples (1) and (2) are shown.

TABLE 2

| (Monochromatic mode) | | | |
|---|---|---|---|
| | CE(1)*1 | CE(2)*2 | EMB.1 |
| EF*3 | ONCE | TWICE | ONCE |
| RT*4 | 5 sec | 10 sec | 5 sec |
| ID*5 | x | ○ | ○ |

*1"CE(1)" is the comparison example (1).
*2"CE(2)" is the comparison example (2).
*3"EF" is the execution frequency (execution number of times) per 50 pages of the adjusting operation during non-image formation.
*4"RT" is the required time (sec) per 50 pages of the downtime with the adjusting operation.
*5"ID" is the presence "○" or absence "x" of the image defect (improper cleaning).

As shown in the table 2, in the comparison example (1), a vertical stripe of improper cleaning extending along the feeding direction of the recording material P occurred on the output image from about timing when the number of sheets printed exceeded 130,000 sheets. When the cleaning blade 31 was observed at a position corresponding to a position where the improper cleaning occurred, deposition of impurities, due to the ion conductive agent which bled out to a free end portion of the blade, on the free end portion was confirmed. That is, in the comparison example (1), it would be considered that the improper cleaning occurred by the ion conductive agent which bled out from the inside of the intermediary transfer belt 20.

In the comparison example (2) in which the execution frequency of the adjusting operation during the non-image formation is increased to twice the execution frequency in the comparison example (1), even when the number of sheets printed reaches 150,000 sheets, the improper cleaning did not occur. In the comparison example (2), the execution frequency of the adjusting operation is high, and therefore, there are many opportunities of rectification of the maldistribution of the ion conductive agent in the intermediary transfer belt 20. For that reason, it would be considered that the bleed out of the ion conductive agent is suppressed and thus the improper cleaning did not occur. However, in the comparison example (2), the required time of the downtime with the adjusting operation is 10 sec per 50 pages which was increased to twice the required time (5 sec) in the comparison example (1).

On the other hand, in this embodiment (embodiment 1), even when the execution frequency of the adjusting operation during the non-image formation was low, the improper cleaning did not occur. In this embodiment, in the secondary transfer step, the secondary transfer target current value in the target current value change region S(T2) is changed from 25 μA which is the secondary transfer target current value Iref(T2), to 18 μA. For that reason, it is possible to suppress the maldistribution of the ion conductive agent in the intermediary transfer belt 20 not only during the non-image formation but also during the image formation. By this, in this embodiment, the execution frequency of the adjusting operation during the non-image formation is suppressed, so that it is possible to suppress the improper cleaning due to the bleed out of the ion conductive agent while suppressing the required time of the downtime.

Thus, in this embodiment, on the basis of the image information, the CPU 311 is capable of performing an operation in which the voltage applied to the secondary transfer member 24 when the image to be formed on a single recording material P is secondary-transferred onto the recording material P is made different between a first voltage at the time when a first region where the coverage indicating the ratio occupied by the image region per predetermined area is a first coverage passes through the secondary transfer portion T2 and a second voltage at the time when a second region where the coverage is a second coverage larger than the first coverage passes through the secondary transfer portion T2, and the change amount of the first voltage with respect to the second voltage is different between the operation in a first mode (full-color image) and the operation in a second mode (monochromatic mode).

As described above, in this embodiment, the secondary transfer target current value in the target current value change region S(T2) is changed from the secondary transfer target current value Iref(T2) determined in advance. By this, it is possible to suppress the maldistribution of the ion conductive agent in the intermediary transfer belt 20 also during the image formation, so that the bleed out of the ion conductive agent can be effectively suppressed while suppressing the execution frequency of the adjusting operation during the non-image formation. Further, in this embodiment, the change amount of the secondary transfer target current value is changed depending on the balance of the amounts of the current flowing through the intermediary transfer belt 20. Typically, the change amount of the secondary transfer target current value is changed between the operation in the full-color image and the operation in the monochromatic mode. By this, it becomes possible to properly suppress the maldistribution of the ion conductive agent in the intermediary transfer belt 20 depending on a maldistribution state of the ion conductive agent due to a difference in operation condition such as the printing mode. Thus, according to this embodiment, the maldistribution of the ion conductive agent in the intermediary transfer belt 20 can be suppressed not only during the non-image formation but also during the image formation, so that it is possible to achieve the balance of the amounts of the current flowing through the intermediary transfer belt 20. As a result, the bleed out of the ion conductive agent is suppressed, so that a good cleaning performance of the cleaning blade 31 can be maintained.

(7) Modified Embodiments

In this embodiment, the threshold of the coverage, indicating a boundary between the low coverage block and the non-low coverage block is set at 30%, but this coverage threshold is not limited to the value in this embodiment. When the threshold is set at a high value, the number of unit blocks discriminated as the low coverage blocks increases, so that the balance of the target current value change region S(T2) in the image increases. Correspondingly, an effect of suppressing the maldistribution of the ion conductive agent is enhanced, and thus advantageously acts on suppression of the bleed out of the intermediary transfer belt 20. However, even in the case of the image with a high coverage, the secondary transfer target current value is changed, so that there is a possibility that a risk of occurrence of the image defect on the output image increases. Accordingly, the coverage threshold may preferably be adjusted appropriately in view of a secondary transfer property of the image forming apparatus 10 and a bleed out property of the intermediary transfer belt 20. It is desirable that the threshold is set at a high value in a condition and a constitution in which the secondary transfer property is advantageous and that the threshold is set at a low value in a condition and a constitution in which reversely, the bleed out property is advantageous. This coverage threshold may also be changed, for example, for every constitution of and individual image forming apparatus 10, and may also be changed depending on the environmental condition, the recording material condition (kind of the recording material), the printing mode, and the like (at least one of these conditions is applicable) even in the same image forming apparatus 10.

Further, in this embodiment, a size of the unit block is set at 24 pixels×24 pixels (total pixel number=576 (pixels)). However, the size of this unit block is not limited to the value in this embodiment, but may preferably be appropriately changed in view of the secondary transfer property of the image forming apparatus 10 and the bleed out property of the intermediary transfer belt 20.

Further, in this embodiment, in the case where Isum(T1) and Isum(T2) are different from each other, the change amount of the secondary transfer target current value in the target current value change region S(T2) is set at +7 μA or −7 μA. However, this change amount is not limited to the values in this embodiment, but may preferably be appropriately changed in view of the secondary transfer property of the image forming apparatus 10 and the bleed out property of the intermediary transfer belt 20. Although the effect of suppressing the maldistribution of the ion conductive agent is enhanced with a larger absolute value of the change amount of the secondary transfer target current value, there is a possibility that a risk of the occurrence of the image defect on the output image increases. For that reason, similarly as in the case of the above-described coverage threshold, an optimum change amount is selected depending on the constitution of the image forming apparatus 10, the environmental condition, the recording material condition, the printing mode, or the like.

Further, in the case where with respect to Iref(T2), there is a difference in degree of allowance of the secondary transfer property between a side where the secondary transfer target current value is high and a side where the secondary transfer target current value is low, the absolute value of the change amount may also be changed between these sides. For example, in the case where with respect to Iref(T2), the degree of allowance of the secondary transfer property on the side where the secondary transfer target current value is low is large, the change amount in S105 of FIG. 5 may also be increased to −9 μA while keeping the change amount in S104 of FIG. 5 at +7 μA. On the other hand, in the case where with respect to Iref(T2), the degree of allowance of the secondary transfer property on the side where the secondary transfer target current value is high is large, the absolute value of the change amount can be made large on the side where the secondary transfer target current value is high.

Further, the change amount of the secondary transfer target current value may also be changed depending on a degree of the maldistribution of the ion conductive agent in the intermediary transfer belt 20. That is, in the case where the degree of the maldistribution of the ion conductive agent is small, it is preferable that the change amount of the secondary transfer target current value is made small and thus the likelihood of occurrence of the image defect on the output image is further lowered. For example, under a condition of Isum(T1)>Isum(T2), in the case where a difference between Isum(T1) and Isum(T2) is a predetermined threshold or more, the change amount of the secondary transfer target current value is set at +7 μA. Further, in the case where the difference between Isum(T1) and Isum(T2) is less than the predetermined threshold, discrimination that the degree of the maldistribution of the ion conductive agent is small can be made, and therefore, the change amount of the secondary transfer target current value is set at +3 μA.

Further, the change amount of the secondary transfer target current value may also be changed depending on the ratio occupied by the target current value change region S(T2) to the image. That is, in the case where the ratio occupied by the target current value change region S(T2) to the image is large, even when the change amount of the secondary transfer target current value is made small, the effect of suppressing the maldistribution of the ion conductive agent is large. For this reason, in this case, it is preferable that the change amount of the secondary transfer target current value is made small and thus the risk of occurrence of the image defect on the output image is further lowered. For example, under a condition of Isum(T1)>Isum(T2), in the case where the ratio occupied by the target current value change region S(T2) to the image is less than a predetermined threshold, the change amount of the secondary transfer target current value is set at +7 μA. Further, in the case where the ratio occupied by the target current value change region S(T2) is the predetermined threshold or more, the change amount of the secondary transfer target current value is set at +5 μA.

Further, the change amount of the secondary transfer target current value may also be changed between the "region where all the unit blocks are low coverage blocks or marginal portions along the main scan direction" and a "region where all the unit blocks are marginal portions along the main scan direction". In the marginal portions, the image defect does not occur, and therefore, it is preferable that the change amount is further increased and thus the maldistribution of the ion conductive agent is positively suppressed.

Further, in this embodiment, the "region where all the unit blocks are low coverage blocks or marginal portions along the main scan direction" is used as the target current value change region S(T2), but the present invention is not limited to such a constitution. For example, in a condition in which a tolerable range of the secondary transfer target current value relating to the secondary transfer property of the low-coverage image or the like condition, only the "region where all the unit blocks are marginal portions" may also be used as the target current value change region S(T2). That is, only in the marginal portions where there is no image, the secondary transfer target current value may also be changed. For example, in a condition of Isum(T1)>Isum(T2), the secondary transfer target current value in a region other than the marginal portion is set at Iref(T2), and the secondary transfer target current value only in the marginal portions is changed to Iref(T2)+7 μA. By this, although a maldistribution suppressing effect of the ion conductive agent somewhat lowers, the secondary transfer target current value is not changed on the image, and therefore, the risk of occurrence of the image defect on the output image can be eliminated.

Incidentally, on the basis of Isum(T1) and Isum(T2), the secondary transfer target current value in the secondary transfer step is changed between the target current value change region S(T2) and a region other than the target current value change region S(T2). With a higher secondary transfer target current value, a value of the secondary transfer voltage applied from the secondary transfer voltage source 44 to the secondary transfer roller 24 also becomes high. For that reason, the high secondary transfer target current value means that the secondary transfer voltage value is also high.

Further, in this embodiment, an example in which the secondary transfer voltage applied to the secondary transfer roller 24 in the secondary transfer step is subjected to the constant-current control was described, but the present invention is not limited thereto. Also, in a constitution in which the secondary transfer voltage applied to the secondary transfer roller 24 in the secondary transfer step is subjected to the constant-voltage control, an effect similar to the effect of this embodiment can be obtained. In the constitution employing the constant-voltage control, on the basis of Isum(T1) and Isum(T2), the secondary transfer voltage value in the secondary transfer step is changed between a region S(T2) corresponding to the target current value change region S(T2) and a region other than the region S(T2). In a condition of Isum(T1)>Isum(T2), the secondary transfer voltage value in the region S(T2) is made larger than the secondary transfer voltage value in the region other than the region S(T2). On the other hand, in a condition of Isum(T1)<Isum(T2), the secondary transfer voltage value in the region S(T2) is made smaller than the secondary transfer voltage value in the region other than the region S(T2). By this, even in the constitution employing the constant-voltage control in the secondary transfer step, it becomes possible to achieve an effect similar to the effect of this embodiment. Incidentally, in this embodiment, the primary transfer voltage is subjected to the constant-voltage control, but may also be subjected to the constant-current control.

Embodiment 2

Next, another embodiment of the present invention will be described. Basic constitutions and operations of an image forming apparatus in this embodiment are the same as those of the image forming apparatus in the embodiment 1. Accordingly, in the image forming apparatus in this embodiment, elements having the same or corresponding functions and constitutions as those in the image forming apparatus in the embodiment 1 are represented by the same reference numerals or symbols and will be omitted from redundant detailed description by quoting the description in the embodiment 1.

In this embodiment, in addition to suppression of the maldistribution of the ion conductive agent in the intermediary transfer belt 20 in the secondary transfer step during the image formation similarly as in the embodiment 1, suppression of the maldistribution of the ion conductive agent in the intermediary transfer belt 20 is also enabled in the primary transfer step during the image formation.

(1) Control Method of Primary Transfer Voltage

Next, a control method of the primary transfer voltage in this embodiment will be described.

<Outline>

In this embodiment, in order to primary-transfer the toner image from the photosensitive drum 2 onto the intermediary transfer belt 20, a primary transfer voltage of a positive polarity is applied from the primary transfer voltage source 40 to the primary transfer rollers 5. In this embodiment, the primary transfer voltage applied to the primary transfer roller 5 in the primary transfer step is subjected to constant-voltage control at a primary transfer voltage value corresponding to the primary transfer target current value Iref (T1). That is, for example, in the case of the full-color image, in this embodiment, in the pre-rotation operation before the image formation, constant-output control of the voltage applied from each of the primary transfer voltage sources 40*a* to 40*d* to the corresponding one of the primary transfer rollers 5*a* to 5*d* is carried out so that a current value detected by the corresponding one of the primary transfer current detecting portions 50*a* to 50*d* is the primary transfer target current value Iref(T1). Further, in the primary transfer step, a primary transfer voltage applied from each of the primary transfer voltage sources 40*a* to 40*d* to the corresponding one of the primary transfer rollers 5*a* to 5*d* is subjected to constant-voltage control in which the voltage value detected during the above-described constant-current control is used as a target voltage value (primary transfer voltage value Vref(T1)). Incidentally, also a setting method of the primary transfer voltage value in the case of the monochromatic mode is similar to the setting method in the case of the above-described operation in the full-color image. However, in the operation in the monochromatic mode, a setting operation of the primary transfer voltage value by the above-described constant-current control is performed only in the image forming portion 1*d* for black.

As the primary transfer target current value Iref(T1), a target current value determined in advance is selected so that an optimum transfer property is obtained depending on the information on the environment (at least one of the temperature and the humidity), the information on the printing mode, or the like information.

That is, in the ROM 312, information on the primary transfer target current value determined in advance depending on the environment information, the printing mode information, or the like information is stored. Further, the image forming apparatus 10 is provided with an environmental sensor (not shown). The CPU 311 is capable of acquiring the environmental information from this environment sensor. Further, the image forming apparatus 10 is capable of acquiring information on the printing mode (full-color image, monochromatic mode, and the like mode) contained in printing job information inputted from the host computer 300 through the controller 301. Accordingly, on the basis of the environmental information and the printing mode information which are acquired above, the CPU 311 is capable of selecting corresponding primary transfer target current value from the primary transfer target current value which is stored in the ROM 312 and which is determined in advance.

One of features of this embodiment is that in the primary transfer step, the primary transfer target current value is not fixed to the primary transfer target voltage value Vref(T1) corresponding to the primary transfer target current value Iref(T1) determined in advance, but is changed depending on the image information of the image primary-transferred onto the intermediary transfer belt 20. Further, another one of the features of this embodiment is that the change amount of the primary transfer voltage value in changed on the basis of the balance of the amounts of the current flowing through the intermediary transfer belt 20.

The control of the primary transfer voltage is roughly classified into "determination of primary transfer voltage change region S(T1)" and "determination of change amount of primary transfer voltage".

<Determination of Primary Transfer Voltage Change Region S(T1)>

First, the "determination of primary transfer voltage change region S(T1)" will be described.

(Principle of Determination of Primary Transfer Voltage Change Region S(T1))

The "determination of primary transfer voltage change region S(T1)" is similar in basic concept to the "determination of target current value change region S(T2)" in the embodiment 1. In this embodiment, a region where in the image primary transferred onto the intermediary transfer belt 20, image defect of an unacceptable level even when the primary transfer voltage value is changed does not occur is determined as the primary transfer voltage change region S(T1).

(Determining Method of Primary Transfer Voltage Change Region S(T1))

Next, a specific method of the "determination of primary transfer voltage change region S(T2)" will be described. This method is similar to the specific method of the "determination of target current value change region S(T2)" in the embodiment 1. Incidentally, in this embodiment, an analyzing object in the "determination of primary transfer voltage change region S(T1)" is an image to be primary-transferred from the photosensitive drum 2 onto the intermediary transfer belt 20 at each of the image forming portions. However, similarly as in the embodiment 1, the analyzing object may also be the image to be secondary-transferred onto the recording material P, and a corresponding effect can be obtained by this.

First, the image analyzer 401 divides an original image (600 dpi) into unit blocks each including 24 pixels×24 pixels (total pixel number=576 (pixels). Then, the image analyzer 401 calculates coverages of all the unit blocks and discriminates whether or not the coverage of each of the unit blocks is smaller than a predetermined threshold. Incidentally, in this embodiment, the threshold of the coverage is set at 30% similarly as in the embodiment 1. In the case where the ratio occupied by the image region in the unit block is 30% or more, the image analyzer 401 determines the unit block as the non-low coverage block. On the other hand, in the case where the ratio occupied by the image region in the unit block is less than 30%, the image analyzer 401 determines the unit block as the low coverage block.

Next, the image analyzer 401 determines the primary transfer voltage change region S(T1) on the basis of a calculation result of the coverage of each of the unit blocks. In this embodiment, similarly as in the case of the target current value change region S(T2) in the embodiment 1, the image analyzer 401 determines the "region where all the unit blocks are low coverage blocks or marginal portions along the main scan direction" as the primary transfer voltage change region S(T1).

(Determination of Change Amount of Primary Transfer Voltage>

Next, "determination of change amount of primary transfer voltage" will be described.

(Determining Method of Change Amount of Primary Transfer Voltage)

In this embodiment, the change amount of the primary transfer voltage in the primary transfer voltage change region S(T1) is determined so as to achieve the balance of the amounts of the current flowing through the intermediary transfer belt 20. By this, the maldistribution (dissociation or maldistribution) of the ion conductive agent in the intermediary transfer belt 20 is suppressed, so that it becomes possible to suppress the bleed out of the electroconductive agent.

In this embodiment, similarly as in the embodiment 1, in order to monitor the balance of the amounts of the current flowing through the intermediary transfer belt 20, the CPU 311 of the engine controller 302 calculates an integrated value of the primary transfer current and an integrated value of the secondary transfer current in real time, and each of the integrated values is stored in the nonvolatile memory 315. Specifically, the CPU 311 integrates a current detection result of each of the primary transfer current detecting portions 50*a* to 50*d* and a current detection result of the secondary transfer current detecting portion 54 every 100 msec from a start of the operation of the image forming apparatus 10, and causes the nonvolatile memory 315 to store these current detection results as Isum(T1) and Isum (T2), respectively.

(Procedure for Determining Change Amount of Primary Transfer Voltage Value)

Next, on the basis of Isum(T1) and Isum(T2), procedure for determining the change amount of the primary transfer voltage value in the primary transfer voltage change region S(T1) will be described. FIG. 7 is a flowchart showing an outline of this procedure. Incidentally, the primary transfer voltage change region S(T1) is also simply referred to as a "region S(T1)".

When the CPU 311 receives a signal of the printing job, the CPU 311 starts the printing job, and then when the primary transfer step in the image forming operation in executed, the CPU 311 discriminates whether or not the region S(T1) exists in the image to be primary-transferred onto the intermediary transfer belt 20 (S201). The CPU 311 makes this discrimination, for every one page image to be primary-transferred from the photosensitive drum 2 onto the intermediary transfer belt 20 at each of image forming portions, on the basis of information on a result of the "determination of primary transfer unit change region S(T1)" acquired from the image analyzer 401. On the basis of information received from the host computer, for every one page image to be primary-transferred from the photosensitive drum 2 onto the intermediary transfer belt 20, the image analyzer 401 makes the "determination of primary transfer voltage change region S(T1)" as described above, and then sends information on a result thereof to the CPU 311. The CPU 311 is capable of causing the RAM 313 to store this information received from the image analyzer 401 as needed, and is capable of reading the information from the RAM 313 and using the information as needed.

In the case where the CPU 311 discriminated in S201 that the region S(T1) does not exist, the CPU 311 keeps the primary transfer voltage value at the primary transfer voltage value Vref(T1) corresponding to the primary transfer voltage value Vref(T1) determined in advance depending on the environmental information, the printing mode information, or the like information (S206).

On the other hand, in the case where the CPU 311 discriminated in S201 that the region S(T1) exists, the CPU 311 determines the primary transfer voltage value in the region S(T1) on the basis of the balance of the amounts of the current flowing through the intermediary transfer belt 20. First, on the basis of Isum(T1) and Isum(T2) read from the nonvolatile memory 315, the CPU 311 discriminates whether or not Isum(T1) and Isum(T2) are the same value (S202).

In the case where the CPU 311 discriminated in S202 that Isum(T1) and Isum(T2) are the same value, the CPU 311 keeps the primary transfer voltage value in the region S(T1) at Vref(T1) (S206). In this case, this is because discrimination that a state in which there is no maldistribution of the balance of the amounts of the current flowing through the intermediary transfer belt 20 is formed can be made. Incidentally, the primary transfer voltage value in a region other than the region S(T1) is also kept at Vref(T1).

Further, in the case where the CPU 311 discriminated in S202 that Isum(T1) and Isum(T2) are not the same (in the case where there arises a difference between Isum(T1) and Isum(T2)), the CPU 311 discriminates whether or not Isum (T1) is larger than Isum(T2) (S203). This is because the primary transfer voltage value in the region S(T1) is changed from the primary transfer voltage value Vref(T1) depending on a magnitude relationship between Isum(T1) and Isum(T2).

In the case where the CPU 311 discriminated in S203 that Isum(T1) is larger than Isum(T2), the CPU 311 sets the primary transfer voltage value in the region S(T1) at a value lower than Vref(T1) (S204). In this case, this is because discrimination that the cationic electroconductive agent cause the maldistribution on the outer peripheral surface of the intermediary transfer belt 20 can be made and thus the maldistribution of the ion conductive agent is suppressed. In this embodiment, the primary transfer voltage value in the region S(T1) in each of the image forming portions 1 is set at −200 V. Incidentally, the primary transfer voltage value in a region other than the region S(T1) is kept at Vref(T1).

On the other hand, in the case where the CPU 311 discriminated in S203 that Isum(T1) is smaller than Isum (T2), the CPU 311 sets the primary transfer voltage value in the region S(T1) at a value higher than Vref(T1) (S205). In this case, this is because discrimination that the anionic electroconductive agent causes the maldistribution on the outer peripheral surface of the intermediary transfer belt 20 can be made and thus the maldistribution of the ion conductive agent is suppressed. In this embodiment, the primary transfer voltage value in the region S(T1) in each of the image forming portions 1 is set at +200 V. Incidentally, the primary transfer voltage value in a region other than the region S(T1) is kept at Vref(T1).

Then, the CPU 311 executes the primary transfer step at the primary transfer voltage value determined as described above for each of the image forming portions 1.

Thus, in this embodiment, on the basis of the balance of the amounts of the current flowing through the intermediary transfer belt 20, the primary transfer voltage value in the primary transfer voltage change region S(T1) is determined, so that it becomes possible to suppress the maldistribution of the ion conductive agent in the intermediary transfer belt 20 during the image formation. Further, in this embodiment, this control is combined with the change in secondary transfer target current value in the target current value change region S(T2) described in the embodiment 1, whereby a higher effect of suppressing the maldistribution of the ion conductive agent can be obtained. However, the present invention is not limited thereto, but of the change in secondary transfer target current value and the change in primary transfer voltage value, only the change in primary transfer voltage value may also be made.

(2) Image Output Experiment Result

Next, a result of an image output experiment conducted for verifying an effect of this embodiment will be described. In the image output experiment, the embodiment 1 and this embodiment (embodiment 2) were compared with each other. Further, the image output experiment was conducted in the operation in the full-color image and in the operation in the monochromatic mode.

<Full-Color Mode>

First, a result of the image output experiment in the operation in the full-color image will be described.

As the image output experiment, a sheet passing durability test described below is conducted, so that a cleaning performance of the cleaning blade 31 of the cleaning device 32 was compared between the embodiment 1 and this embodiment.

A test environment was 23° C. in temperature and 50% RH in relative humidity. As the recording material P, paper ("GF-0081" (trade name), manufactured by Canon Marketing Japan Inc.) was used. In the operation, as the printing mode, the full-color normal printing mode was employed, and continuous printing was executed. In the operation in this mode, a process speed is 300 mm/sec, and a throughput is 55 sheets per minute. In this condition, Iref(T1) is 15 μA, Vref(T1) is 1500 V and Iref(T2) is 30 μA.

As an output image, the following images were used. On half of the recording material P on a leading end side with respect to the feeding direction of the recording material P, an image which has a print ratio of 2% for each of images of yellow, magenta, cyan and black and which has a coverage of 8% in unit block is formed. On half of the recording material P on a trailing end side with respect to the feeding direction of the recording material P, a solid image which has a print ratio of 25% for each of images of yellow, magenta, cyan and black and which has a coverage of 100% in unit block is formed. That is, each of a ratio (area) occupied by the target current value change region S(T2) in this output image and a ratio (area) occupied by the primary transfer voltage change region S(T1) in this output image is 50%.

Further, in this sheet passing durability test, an adjusting operation during non-image formation is executed at a predetermined frequency during continuous printing, so that maldistribution of the ion conductive agent in the intermediary transfer belt 20 was corrected. That is, the printing is once interrupted when the printing of a predetermined number of pages is carried out, and the adjusting operation during the non-image formation was executed. Specific contents of the adjusting operation are the same as those described in the sheet passing durability test in the operation in the full-color image of the embodiment 1.

Further, sampling of the output image was conducted during the sheet passing durability test, and evaluation was made by observing whether or not improper cleaning occurred on the output image until the printing of 150,000 sheets was ended. An evaluation criterion was that the case where the improper cleaning did not occur is "o (good)". A result is shown in a table 3. In the table 3, the execution frequency of the adjusting operation, the required time of downtime of the adjusting operation, and presence or absence of the image defect (improper cleaning) during the sheet passing durability test in this embodiment and the embodiment 1 are shown.

TABLE 3

| (Full-color mode) | | |
|---|---|---|
| | EMB. 1 | EMB. 2 |
| EF*1 | TWICE | ONCE |
| RT*2 | 10 sec | 5 sec |
| ID*3 | ○ | ○ |

*1"EF" is the execution frequency of the adjusting operation during non-image formation (the number of times of execution per 100 pages).
*2"RT" is the required time of the downtime with the adjusting operation (the required time per 100 pages).
*3"ID" is the presence or absence of the image defect (improper cleaning).

As shown in the table 3, in either of the embodiment 1 and this embodiment (embodiment 2), the improper cleaning did not occur.

However, in the constitution of this embodiment, different from the constitution of the embodiment 1, the improper cleaning did not occur even under a condition in which the execution frequency of the adjusting operation during the non-image formation was lowered to once per 100 pages, the improper cleaning did not occur, and a good result similar to the result of the embodiment 1 was obtained. In this embodiment, the secondary transfer target current value in the region (S2) is changed from the secondary transfer target current value Iref(T2). Further, in this embodiment, the primary transfer voltage value in the region S(T1) is changed from 1500 V which is Vref(T1) to 1300 V. For that reason, it is possible to suppress the maldistribution of the ion conductive agent in the intermediary transfer belt 20 not only in the secondary transfer step but also in the primary transfer step. By this, in this embodiment, the execution frequency of the adjusting operation during the non-image formation is further lowered, so that it is possible to suppress the improper cleaning due to the bleed out of the ion conductive agent while suppressing the required time of the downtime.

<Monochromatic Mode>

First, a result of the image output experiment in the operation in the monochromatic mode will be described.

Similarly, as the above-described image output experiment in the operation in the full-color image, a sheet passing durability test described below is conducted, so that a cleaning performance of the cleaning blade 31 of the cleaning device 32 was compared between the embodiment 1 and this embodiment.

A test environment was 23° C. in temperature and 50% RH in relative humidity. As the recording material P, paper ("GF-0081" (trade name), manufactured by Canon Marketing Japan Inc.) was used. In the operation, as the printing mode, the monochromatic normal printing mode was employed, and continuous printing was executed. In the operation in this mode, a process speed is 300 mm/sec, and a throughput is 55 sheets per minute. In this condition, Iref(T1) is 15 μA, Vref(T1) is 1500 V and Iref(T2) is 25 μA.

As an output image, the following images were used. On half of the recording material P on a leading end side with respect to the feeding direction of the recording material P, an image (black) with a coverage of 8% in unit block is formed. On half of the recording material P on a trailing end side with respect to the feeding direction of the recording material P, a solid image (black) with a coverage of 100% in unit block is formed. That is, each of a ratio (area) occupied by the target current value change region S(T2) in this output image and a ratio (area) occupied by the primary transfer voltage change region S(T1) in this output image is 50%.

Further, in this sheet passing durability test, an adjusting operation during non-image formation is executed at a predetermined frequency during continuous printing, so that maldistribution of the ion conductive agent in the intermediary transfer belt 20 was corrected. Specific contents of the adjusting operation are the same as those described in the sheet passing durability test in the operation in the monochromatic mode of the embodiment 1.

Further, sampling of the output image was conducted during the sheet passing durability test, and evaluation was made by observing whether or not improper cleaning occurred on the output image until the printing of 150,000 sheets was ended. An evaluation criterion was that the case where the improper cleaning did not occur is "o (good)". A result is shown in a table 4. In the table 4, the execution frequency of the adjusting operation, the required time of downtime of the adjusting operation, and presence or absence of the image defect (improper cleaning) during the sheet passing durability test in this embodiment and the embodiment 1 are shown.

TABLE 4

| (Monochromatic mode) | | |
|---|---|---|
| | EMB. 1 | EMB. 2 |
| EF*1 | TWICE | ONCE |
| RT*2 | 10 sec | 5 sec |
| ID*3 | ○ | ○ |

*1"EF" is the execution frequency of the adjusting operation during non-image formation (the number of times of execution per 100 pages).
*2"RT" is the required time of the downtime with the adjusting operation (the required time per 100 pages).
*3"ID" is the presence or absence of the image defect (improper cleaning).

As shown in the table 4, in either of the embodiment 1 and this embodiment (embodiment 2), the improper cleaning did not occur.

However, in the constitution of this embodiment, different from the constitution of the embodiment 1, the improper cleaning did not occur even under a condition in which the execution frequency of the adjusting operation during the non-image formation was lowered to once per 100 pages, the improper cleaning did not occur, and a good result similar to the result of the embodiment 1 was obtained. In this embodiment, the secondary transfer target current value in the region (S2) is changed from the secondary transfer target current value Iref(T2). Further, in this embodiment, the primary transfer voltage value in the region S(T1) is changed from 1500 V which is Vref(T1) to 1700 V. For that reason, it is possible to suppress the maldistribution of the ion conductive agent in the intermediary transfer belt 20 not only in the secondary transfer step but also in the primary transfer step. By this, in this embodiment, the execution frequency of the adjusting operation during the non-image formation is further lowered, so that it is possible to suppress the improper cleaning due to the bleed out of the ion conductive agent while suppressing the required time of the downtime.

Thus, in this embodiment, on the basis of the image information, the CPU 311 is capable of performing an operation in which the voltage applied to the primary transfer member 5 when the image to be formed on a single recording material P is primary-transferred onto the intermediary transfer belt 20 is made different between a first voltage at the time when a first region where the coverage indicating the ratio occupied by the image region per predetermined area is a first coverage passes through the primary transfer portion T1 and a second voltage at the time when a second region where the coverage is a second coverage larger than the first coverage passes through the primary transfer portion T1, and the change amount of the first voltage with respect to the second voltage is different between the operation in a first mode (full-color image) and the operation in a second mode (monochromatic mode).

As described above, in this embodiment, not only the secondary transfer target current value in the target current value change region S(T2) is changed, but also the primary transfer voltage value in the primary transfer voltage change region S(T1) is changed. By this, during the image formation, it is possible to suppress the maldistribution of the ion conductive agent in the intermediary transfer belt 20 not only in the secondary transfer step but also in the primary transfer step, so that the bleed out of the ion conductive agent can be further effectively suppressed. Further, in this embodiment, each of the change amount of the secondary transfer target current value and the change amount of the primary transfer voltage value is changed depending on the balance of the amounts of the current flowing through the intermediary transfer belt 20. Typically, each of the change amount of the secondary transfer target current value and the change amount of the primary transfer voltage value is changed between the operation in the full-color image and the operation in the monochromatic mode. By this, it becomes possible to properly suppress the maldistribution of the ion conductive agent in the intermediary transfer belt 20 depending on a maldistribution state of the ion conductive agent due to a difference in operation condition such as the printing mode.

(3) Modified Embodiments

In this embodiment, the threshold of the coverage, indicating a boundary between the low coverage block and the non-low coverage block is set at 30%, but this coverage threshold is not limited to the value in this embodiment. When the threshold is set at a high value, the number of unit blocks discriminated as the low coverage blocks increases, so that the balance of the primary transfer voltage change region S(T1) in the image increases. Correspondingly, an effect of suppressing the maldistribution of the ion conductive agent is enhanced, and thus advantageously acts on suppression of the bleed out of the intermediary transfer belt 20. However, even in the case of the image with a high coverage, the primary transfer voltage value is changed, so that there is a possibility that a risk of occurrence of the image defect on the output image increases. Accordingly, the coverage threshold may preferably be adjusted appropriately in view of a primary transfer property of the image forming apparatus 10 and a bleed out property of the intermediary transfer belt 20. It is desirable that the threshold is set at a high value in a condition and a constitution in which the secondary transfer property is advantageous and that the threshold is set at a low value in a condition and a constitution in which reversely, the bleed out property is advantageous. This coverage threshold may also be changed, for example, for every constitution of and individual image forming apparatus 10, and may also be changed depending on the environmental condition, the printing mode, and the like even in the same image forming apparatus 10.

Further, in this embodiment, the threshold for determining the region S(T1) and the threshold for determining the region S(T2) were set at the same value, but setting of these values is not limited to setting in which these values are set at the same value. The thresholds for determining the region S(T1) and the region S(T2) may also be different values depending on the primary transfer property and the secondary transfer property of the image forming apparatus 10.

Further, in this embodiment, a size of the unit block is set at 24 pixels×24 pixels (total pixel number=576 (pixels)). However, the size of this unit block is not limited to the value in this embodiment, but may preferably be appropriately changed in view of the primary transfer property of the image forming apparatus 10 and the bleed out property of the intermediary transfer belt 20.

Further, in this embodiment, in the case where Isum(T1) and Isum(T2) are different from each other, the change amount of the primary transfer voltage value in the primary transfer voltage change region S(T1) is set at +200 V or −200 V. However, this change amount is not limited to the values in this embodiment, but may preferably be appropriately changed in view of the primary transfer property of the image forming apparatus 10 and the bleed out property of the intermediary transfer belt 20. Although the effect of suppressing the maldistribution of the ion conductive agent is enhanced with a larger absolute value of the change amount of the primary transfer voltage value, there is a possibility that a risk of the occurrence of the image defect on the output image increases. For that reason, similarly as in the case of the above-described coverage threshold, an optimum change amount is selected depending on the constitution of the image forming apparatus 10, the environmental condition, the printing mode, or the like.

Further, in the case where with respect to Vref(T1), there is a difference in degree of allowance of the primary transfer property between a side where the primary transfer voltage value is high and a side where the primary transfer voltage value is low, the absolute value of the change amount may also be changed between these sides. For example, in the case where with respect to Vref(T1), the degree of allowance of the primary transfer property on the side where the primary transfer voltage value is high is large, the change amount in S205 of FIG. 7 may also be increased to +300 V while keeping the change amount in S204 of FIG. 7 at −200 V. On the other hand, in the case where with respect to Vref(T1), the degree of allowance of the primary transfer property on the side where the primary transfer voltage value is low is large, the absolute value of the change amount can be made large on the side where the primary transfer voltage value is low.

Further, the change amount of the primary transfer voltage value may also be changed depending on a degree of the maldistribution of the ion conductive agent in the intermediary transfer belt 20. That is, in the case where the degree of the maldistribution of the ion conductive agent is small, it is preferable that the change amount of the primary transfer voltage value is made small and thus the likelihood of occurrence of the image defect on the output image is further lowered. For example, under a condition of Isum(T1)>Isum(T2), in the case where a difference between Isum(T1) and Isum(T2) is a predetermined threshold or more, the change amount of the primary transfer voltage value is set at −200 V. Further, in the case where the difference between Isum(T1) and Isum(T2) is less than the predetermined threshold, discrimination that the degree of the maldistribution of the ion conductive agent is small can be made, and therefore, the change amount of the primary transfer voltage value is set at −100 V.

Further, the change amount of the primary transfer voltage value may also be changed depending on the ratio occupied by the primary transfer voltage change region S(T1) to the image. That is, in the case where the ratio occupied by the primary transfer voltage change region S(T1) to the image is large, even when the change amount of the primary transfer voltage value is made small, the effect of suppressing the maldistribution of the ion conductive agent is large. For this reason, in this case, it is preferable that the change amount of the primary transfer voltage value is made small and thus the risk of occurrence of the image defect on the output image is further lowered. For example, under a condition of Isum(T1)>Isum(T2), in the case where the ratio occupied by the region S(T1) to the image is less than a predetermined threshold, the change amount of the primary transfer voltage value is set at −200 V. Further, in the case where the ratio occupied by the target current value change region S(T2) is the predetermined threshold or more, the change amount of the primary transfer voltage value is set at −150 V.

Further, the change amount of the primary transfer voltage value may also be changed between the "region where all the unit blocks are low coverage blocks or marginal portions along the main scan direction" and a "region where all the unit blocks are marginal portions along the main scan direction". In the marginal portions, the image defect does not occur, and therefore, it is preferable that the change amount is further increased and thus the maldistribution of the ion conductive agent is positively suppressed.

Incidentally, in the case where the change amount of the primary transfer voltage value is changed to a high side, when the primary transfer voltage value is set at an extremely high voltage, there is a possibility that a drum memory (described later) occurs. When the extremely high voltage is applied to the primary transfer roller 5, due to excessive electric discharge, the surface potential of the photosensitive drum 2 causes potential non-uniformity. In the case where this surface potential non-uniformity is not evened out to a uniform potential in a subsequent charging step, a ghost image ("drum memory") due to the surface potential non-uniformity occurs after rotation of the photosensitive drum 2 through one-full-circumference. For that reason, an upper-limit value of the change amount of the primary transfer voltage value may desirably be set so as to be lower than the threshold of the primary transfer voltage value at which the drum memory occurs.

Further, in this embodiment, the "region where all the unit blocks are low coverage blocks or marginal portions along the main scan direction" is used as the primary transfer voltage change region S(T1), but the present invention is not limited to such a constitution. For example, in a condition of a tolerable range of the primary transfer voltage value relating to the primary transfer property of the low-coverage image or the like condition, only the "region where all the unit blocks are marginal portions" may also be used as the primary transfer voltage change region S(T1). That is, only in the marginal portions where there is no image, the primary transfer voltage value may also be changed. For example, in a condition of Isum(T1)>Isum(T2), the primary transfer voltage value in a region other than the marginal portion is set at Vref(T1), and the primary transfer voltage value only in the marginal portions is changed to Vref(T1)−200 V. By this, although a maldistribution suppressing effect of the ion conductive agent somewhat lowers, the primary transfer voltage value is not changed on the image, and therefore, the risk of occurrence of the image defect on the output image can be eliminated.

Incidentally, on the basis of Isum(T1) and Isum(T2), the primary transfer voltage value in the primary transfer step is changed between the primary transfer voltage change region S(T1) and a region other than the primary transfer voltage change region S(T1). With a higher primary transfer voltage value, a value of the primary transfer current detected by the primary transfer current detecting portion 50 also becomes high. For that reason, the high primary transfer voltage value means that the primary transfer current is also high.

Further, in this embodiment, an example in which the primary transfer voltage applied to the primary transfer roller 5 in the primary transfer step is subjected to the constant-voltage control was described, but the present invention is not limited thereto. Also, in a constitution in which the primary transfer voltage applied to the primary transfer roller 5 in the primary transfer step is subjected to the constant-current control, an effect similar to the effect of this embodiment can be obtained. In the constitution employing the constant-current control, on the basis of Isum(T1) and Isum(T2), the primary transfer target current value in the primary transfer step is changed between a region S(T1) corresponding to the primary transfer voltage change region S(T1) and a region other than the region S(T1). In a condition of Isum(T1)>Isum(T2), the primary transfer target current value in the region S(T1) is made smaller than the primary transfer target current value in the region other than the region S(T1). On the other hand, in a condition of Isum(T1)<Isum(T2), the primary transfer target current value in the region S(T1) is made larger than the primary transfer target current value in the region other than the region S(T1). By this, even in the constitution employing the constant-current control in the primary transfer step, it becomes possible to achieve an effect similar to the effect of this embodiment.

Further, in this embodiment, the primary transfer voltage sources 40*a* to 40*d* are connected to the primary transfer rollers 5*a* to 5*d*, respectively, and the primary transfer voltage is independently applied to each of the primary transfer rollers 5*a* to 5*d*, but commonality of the primary transfer voltage source 40 between the plurality of primary transfer rollers 5 may also be achieved. For example, as shown in FIG. 8, the primary transfer rollers 5*a* to 5*c* for yellow, cyan, and magenta, respectively, may also be connected to a common primary transfer voltage source (high-voltage source circuit) 80. This primary transfer voltage source 80 is connected to the primary transfer rollers 5*a* to 5*c* through a common primary transfer current detecting portion (primary transfer current detecting circuit) 81. In this case, a common primary transfer voltage is simultaneously applied from the primary transfer voltage source 80 to the primary transfer rollers 5*a* to 5*c*. In the case of a constitution shown in FIG. 8, a condition of changing a value of the primary transfer voltage applied from the primary transfer voltage source 80 to the primary transfer rollers 5*a* to 5*c* is limited to a timing when the primary transfer voltage change region S(T1) exists in each of the primary transfer portions T1 for all the colors of yellow, magenta, and cyan. When the common primary transfer voltage value is changed in the case where there is no region S(T1) in the primary transfer portion T1 for any one of the colors of yellow, cyan, and magenta, there is a possibility that the image defect occurs in the image of this color. For that reason, in the constitution shown in FIG. 8, when the primary transfer voltage value in the primary transfer step is changed on the basis of Isum(T1) and Isum(T2), only at the timing when the primary transfer voltage change region S(T1) exists in each of the primary transfer portions T1 for all the colors of yellow, magenta and cyan, the value of the primary transfer voltage applied from the primary transfer voltage source 80 to the above-described primary transfer rollers 5*a* to 5*c* is subjected to the constant-current control.

Embodiment 3

Next, another embodiment of the present invention will be described. Basic constitutions and operations of an image forming apparatus in this embodiment are the same as those of the image forming apparatus in the embodiment 1. Accordingly, in the image forming apparatus in this embodiment, elements having the same or corresponding functions and constitutions as those in the image forming apparatus in the embodiment 1 are represented by the same reference numerals or symbols and will be omitted from redundant detailed description by quoting the description in the embodiment 1.

In this embodiment, a constitution in which the image forming apparatus 10 includes a member for applying a voltage to (for supplying a current to) the intermediary transfer belt 20 separately from the primary transfer member and the secondary transfer member will be described. In this embodiment, as the member, a constitution including an electroconductive brush 70 as shown in FIG. 9 is provided will be described. FIG. 9 is a schematic sectional view of a principal part of the image forming apparatus 10 in this embodiment.

In the constitution shown in FIG. 9, the image forming apparatus 10 includes the electroconductive brush 70 as an auxiliary cleaning member contacting the outer peripheral surface of the intermediary transfer belt 20. The electroconductive brush 70 is positioned downstream of the cleaning blade 31 and upstream of the primary transfer portion T1 (most upstream primary transfer portion T1*a*) with respect to the feeding direction of the intermediary transfer belt 20. The electroconductive brush 70 has a function, as described later, of suppressing appearance of image defect due to improper cleaning on the output image by electrostatically collecting a part of secondary transfer residual toner which is not collected by the cleaning blade 31.

Brush fibers of the electroconductive brush 70 in this embodiment are constituted by using, as a material thereof, nylon to which electroconductivity is imparted, and are 7 deniers in fineness, 5 mm in pile length, 70 KV/inch$^2$ in density and 5 mm in brush width (with respect to the feeding direction of the intermediary transfer belt 20). An electric resistance value of the electroconductive brush 70 in this embodiment is $1.0\times10^6\Omega$ in the case where the electroconductive brush 70 is pressed against an aluminum cylinder with a force of 9.8 N and a voltage of 500 V is applied thereto in a state in which the aluminum cylinder is rotated at a peripheral speed of 50 mm/sec.

As shown in FIG. 9, the electroconductive brush 70 is electrically connected to a cleaning voltage source (high-voltage source circuit) 72 through a cleaning current detecting portion (cleaning current detecting circuit) 71. In this embodiment, the cleaning voltage source 72 is capable of selectively applying a positive voltage and a negative voltage to the electroconductive brush 70.

During a belt cleaning operation, to the electroconductive brush 70, a DC voltage of a positive polarity is applied from the cleaning voltage source 72. The cleaning voltage source 72 subjects the voltage, applied to the electroconductive brush 70, to the constant-current control by adjusting a voltage output value so that a current value detected by the cleaning current detecting portion 71 becomes a target current value. As the target current value, a value at which the toner passed through the cleaning blade 31 is not excessively charged and improper cleaning due to improper charging is not caused is selected. In this embodiment, the target current value of the voltage applied to the electroconductive brush 70 during the belt cleaning operation is 20 μA.

During the belt cleaning operation, the positive voltage is applied to the electroconductive brush 70, so that a positive electric field from the electroconductive brush 70 toward the intermediary transfer belt 20 is formed. By this, of the toner passed through the cleaning blade 31 not only the toner charged to the negative polarity is electrostatically collected, but also the secondary transfer residual toner is charged to the positive polarity by electric discharge between the electroconductive brush 70 and the secondary transfer residual toner. The secondary transfer residual toner charged to the positive polarity by the electroconductive brush 70 moves to the primary transfer portion T1*a* of the image forming portion 1*a* with the rotation of the intermediary transfer belt 20. Then, by the action of the positive primary transfer voltage applied to the primary transfer roller 5*a* of the image forming portion 1*a*, the secondary transfer residual toner is transferred (reversely transferred) from the intermediary transfer belt 20 onto the photosensitive drum 2*a* of the image forming portion 2*a*. This reverse transfer is capable of being carried out simultaneously with the primary transfer. The toner reversely transferred on the photosensitive drum 2*a* is then removed and collected from the photosensitive drum 2*a* by the drum cleaning device 6*a* of the image forming portion 1*a*. Thus, by the electroconductive brush 70, not only a part of the toner passed through the cleaning blade 31 is electrostatically collected, but also the toner passed through the electroconductive brush 70 is positively charged and is collected by the primary transfer portion T1*a*. By this, the toner passed through the cleaning blade 31 can be removed from the intermediary transfer belt 20.

In the constitution shown in FIG. 9, in the case where the balance of the amounts of the current flowing through the intermediary transfer belt 20 is considered, the current flowing from the primary transfer member and the secondary transfer member through the intermediary transfer belt 20 may preferably be taken into consideration.

Therefore, in this embodiment, the CPU 311 of the engine controller 302 calculates Isum(B) in real time, which is an integrated value of the current flowing through the electroconductive brush 70, in addition to Isum(T1) and Isum(T2) described in the embodiments 1 and 2, and then causes the nonvolatile memory 315 to store Isum(B). Specifically, every 100 msec from a start of the operation of the image forming apparatus 10, the CPU 311 integrates the current detection result of the cleaning current detecting portion 71 in real time and then causes the nonvolatile memory 315 to store the integrated value as Isum(B). That is, the nonvolatile memory 315 is provided with a storing area for storing each of Isum(T1), Isum(T2) and Isum(B).

Further, in this embodiment, when the secondary transfer target current value in the target current value change region S(T2) described in the embodiment 1 is determined, the CPU 311 considers not only Isum(T1) and Isum(T2) but also Isum(B). Similarly, in this embodiment, when the primary transfer voltage value in the primary transfer voltage change region S(T1) described in the embodiment 2 is determined, the CPU 311 considers not only Isum(T1) and Isum(T2) but also Isum(B).

For example, in the embodiment 1, the secondary transfer target current value in the target current value change region S(T2) was determined on the basis of a magnitude relationship between Isum(T1) and Isum(T2). On the other hand, in this embodiment, the secondary transfer target current value is detected by comparing "Isum(T2)+Isum(B)" which is a sum of the amount of the current flowing from the outer peripheral surface side to the inner peripheral surface side of the intermediary transfer belt 20 with "Isum(T1)" which is a sum of the amount of the current flowing the inner peripheral surface side to the outer peripheral surface side of the intermediary transfer belt 20. By this, it is possible to take into consideration also the influence of the electroconductive brush 70 on the maldistribution of the ion conductive agent. Specifically, in this embodiment, "Isum(T1)≠Isum(T2)?" in the process of S102 in FIG. 5 is changed to "Isum(T1)≠Isum(T2)+Isum(B)?". Further, in this embodiment, "Isum(T1)>Isum(T2)?" in the process of S103 in FIG. 5 is changed to "Isum(T1)>Isum(T2)+Isum(B)?".

Similarly, the primary transfer voltage value in the primary transfer voltage change region S(T1) described in the embodiment 2 is also detected by comparing "Isum(T2)+Isum(B)" with the "Isum(T1)". Specifically, in this embodiment, "Isum(T1)≠Isum(T2)?" in the process of S202 in FIG. 7 is changed to "Isum(T1)≠Isum(T2)+Isum(B)?". Further, in this embodiment, "Isum(T1)>Isum(T2)?" in the process of S203 in FIG. 7 is changed to "Isum(T1)>Isum(T2)+Isum(B)?".

Thus, in a constitution in which the member for applying the voltage to (for supplying the current to) the intermediary transfer belt 20 is provided separately from the primary transfer member and the secondary transfer member, the integrated value of the current flowing through this member (Isum(B) in this embodiment) is also taken into consideration. By this, a degree of the maldistribution of the ion conductive agent in the intermediary transfer belt 20 can be grasped with accuracy. Further, depending on the degree of the maldistribution of the ion conductive agent, the secondary transfer target current value in the target current value change region S(T2) or the primary transfer voltage value in the primary transfer voltage change region S(T1) is properly changed, so that the bleed out of the ion conductive agent can be suppressed.

Incidentally, in this embodiment, the constitution in which the electroconductive brush 70 is provided as the member for applying the voltage to (for supplying the current to) the intermediary transfer belt 20 separately from the primary transfer member and the secondary transfer member was described, but the present invention is not limited to such a constitution. As the voltage applying member (current supplying member), for example, it is possible to cite an electroconductive brush fixedly provided, a rotatable fur brush, an electroconductive elastic roller provided with an elastic member layer (elastic layer), an electroconductive sheet, and the like.

Further, the number of the member for applying the voltage to (for supplying the current to) the intermediary transfer belt 20 separately from the primary transfer member and the secondary transfer member is not limited to one, but a plurality of such members may also be provided. At that time, as regards the balance of the amounts of the current flowing through the intermediary transfer belt, it is preferable that not only the currents flowing from the primary transfer member and the secondary transfer member to the intermediary transfer belt but also currents flowing from all the voltage application members other than the primary transfer member and the secondary transfer member are taken into consideration. That is, by comparing the sum of the current flowing from the outer peripheral surface side to the inner peripheral surface side of the intermediary transfer belt with the sum of the current flowing from the inner peripheral surface side to the outer peripheral surface side of the intermediary transfer belt, the degree of the maldistribution of the ion conductive agent can be grasped with high accuracy.

Other Embodiments

The present invention was described based on the specific embodiments mentioned above, but is not limited to the above-mentioned embodiments.

In the above-described embodiments, the "printing where all the unit blocks are low coverage blocks or marginal portions along the main scan direction" is set at the target current value change region (T2) or the primary transfer voltage change region S(T1). On the other hand, the region S(T2) and the region S(T1) may also be detected by using not only the coverage information but also print ratio information. For example, as in a test of red, in an image which the print ratio is higher even when the coverage is low, there is a condition in which there is a possibility of occurrence of image defect when the secondary transfer target current value or the primary transfer voltage value is changed. This is because in such an image, the case where a tolerable range of the secondary transfer target current value relating to the secondary transfer property and a tolerable range of the primary transfer voltage value relating to the primary transfer property are narrow exists. In this case, the region S(T2) and the region S(T1) may also be determined by using not only the coverage information but also the print ratio information. As an example, a condition such that a region where the coverages of all the unit blocks are less than 30% and where a total of the print ratios for the respective colors is less than 50% is used as the region S(T2) or the region S(T1) may also be used.

Further, in the above-described embodiments, each of Isum(T1), Isum(T2) and Isum(B) is the integrated value of the current detected by the associated current detecting portion every 100 msec, but the present invention is not limited to such a constitution. For example, weighting for an addition value may also be carried out depending on the condition or the constitution. The reason why the addition value is subjected to weighting is that the degree of the maldistribution is grasped with high accuracy by taking into consideration a difference in influence on the maldistribution of the ion conductive agent caused by a difference in condition or constitution. For example, even when the current detection result of the secondary transfer current detecting portion 54 is the same between when the recording material P passes through the secondary transfer portion T2 ("during sheet passing") and when the recording material P does not pass through the secondary transfer portion T2 ("during non-sheet passing"), in some instances, a degree of progress of the maldistribution of the ion conductive agent is larger during sheet passing than during non-sheet passing. In this case, the addition value to Isum(T2) may preferably be set at a higher value during sheet passing than during non-sheet passing. As an example, during non-sheet passing, a value which is 1.0 time the secondary transfer target current value is added every 100 msec, whereas during sheet passing, a value which is 1.1 times the secondary transfer target current value is added very 100 msec. Further, the degree of the maldistribution of the ion conductive agent varies also depending on a kind of the recording material P passing through the secondary transfer portion T2 in some instances. In this case, a coefficient of weighting may also be changed depending on the recording material information. Thus, in the case where even at the same secondary transfer target current value, the influence on the degree of the maldistribution of the ion conductive agent is different, the amount added to Isum(T2) may preferably be appropriately changed.

Further, in the case where the degree of the maldistribution of the ion conductive agent is different between the primary transfer member, the secondary transfer member and other voltage application members, weighting for the addition value to each of Isum(T1), Isum(T2) and Isum(B) may preferably be carried out. For example, in a state in which the current detection result of the secondary transfer current detecting portion 54 and the current detection result of the cleaning current detecting portion 71 are the same value, the influence of the electroconductive brush 70 on the maldistribution of the ion conductive agent is smaller than the influence of the secondary transfer roller 24 on the maldistribution of the ion conductive agent in some instances. In this case, it is preferable that the addition value to Isum(T2) is set at a value higher than the addition value to Isum(B). As an example, a value which is 1.0 time the detection result of the secondary transfer current detecting portion 54 is added every 100 msec, whereas a value which is 0.9 time the detection result of the cleaning current detecting portion 71 is added every 100 msec. Thus, in the case where the influence on the degree of the maldistribution of the ion conductive agent is different even when the current detection results are the same, the amount added to each of Isum(T1), Isum(T2) and Isum(B) may preferably be changed appropriately.

Further, Isum(T1), Isum(T2) and Isum(B) may also be subtracted depending on a stop time of the image forming apparatus 10. The reason for this is that the case where the maldistribution of the ion conductive agent is naturally alleviated in a rest state of the image forming apparatus 10 exists and is taken into consideration. For example, in the case where of continuous printing and intermittent printing in which a certain rest time is provided every (one) page, the degree of the maldistribution of the ion conductive agent after printing of images on a predetermined number of sheets is made does not progress in the intermittent printing, so it is preferable that the natural alleviation in the rest state is taken into consideration. In this case, depending on the rest time, a predetermined value is subtracted from each of Isum(T1), Isum(T2) and Isum(B), so that it becomes possible to further accurately grasp the maldistribution degree of the ion conductive agent in the intermediary transfer belt 20.

Further, in the above-described embodiments, integration of each of Isum(T1), Isum(T2) and Isum(B) was carried out for full circumference of the intermediary transfer belt 20. On the other hand, each of Isum(T1), Isum(T2) and Isum(B) may also be integrated for every divided region of the intermediary transfer belt 20 with respect to a circumferential direction. The reason for this is that a degree of the maldistribution (localization) of the ion conductive agent with respect to the circumferential direction of the intermediary transfer belt 20 is taken into consideration. As regards the intermediary transfer belt 20, a contact position of each of the voltage application members is different, and therefore, depending on the condition, there is a possibility of an occurrence of a bias such that the maldistribution of the ion conductive agent extremely progresses in a certain region with respect to the circumferential direction of the intermediary transfer belt 20, whereas in another region, the ion conductive agent is not so localized. Therefore, the image forming apparatus 10 can be constituted so that the maldistribution degree of the ion conductive agent in every region of the intermediary transfer belt 20 with respect to the circumferential direction can be grasped by grasping the position of the intermediary transfer belt 20 with respect to the circumferential direction. In the following, with reference to FIG. 10, an example of such a constitution will be described. In this embodiment, the constitution in which the electroconductive brush 70 is provided similarly as in the embodiment 3 will be described as an example.

For example, as shown in FIG. 10, at a part of the intermediary transfer belt 20 with respect to the circumferential direction, a marker 91 as a position indication means is provided. As the marker 91, a member (seal or the like) different in reflection characteristic (reflectance) from the surface of the intermediary transfer belt 20 is provided or the surface of the intermediary transfer belt 20 is provided with unevenness or is scarred. Further, the image forming apparatus 10 is provided with a position detection sensor 92 as a position detecting means for reading the marker 91. As the position detection sensor 92, an optical sensor in which reflection light from the intermediary transfer belt 20 or the marker 91 is received and the marker 91 is detected on the basis of a change in reflected light quantity can be used. By this, the position of the intermediary transfer belt 20 with respect to the circumferential direction can be grasped on the basis of the position of the marker 91. Further, for example, as shown in FIG. 10, on the basis of the position of the marker 91, the intermediary transfer belt 20 is divided into N regions (9 regions in FIG. 10) with respect to the circumferential direction of the intermediary transfer belt 20. Further, for each of these N regions, Isum(T1), Isum(T2) and Isum(B) are integrated in real time and are stored in the nonvolatile memory 315. That is, the nonvolatile memory 315 is provided with storing areas for storing Isum−N(1), Isum−N(T2) and Isum−N(B) for each of the above-described N regions. For example, to Isum−1(T2), only a current detected by the secondary transfer current detecting portion 54 when a region N=1 of the intermediary transfer belt 20 with respect to the circumferential direction passes through the secondary transfer portion T2 is added. Further, for example, to Isum−2(B), only a current detected by the cleaning current detecting portion 71 when a region N=2 of the intermediary transfer belt 20 with respect to the circumferential direction passes through the contact portion of the electroconductive brush 70 is added. Thus, integration of the current value is carried out for every region of the intermediary transfer belt 20 with respect to the circumferential direction.

Further, the secondary transfer target current value in the target current value change region S(T2) and the primary transfer voltage value in the primary transfer voltage change region S(T1) are determined on the basis of Isum−N(T1), Isum−N(T2) and Isum−N(B) in each of the regions of the intermediary transfer belt 20 with respect to the circumferential direction. For example, it is assumed that a relationship between Isum−N(T1), Isum−N(T2) and Isum−N(B) is Isum−N(T1)>Isum−N(T2)+Isum−N(B) in the region N=1. Further, it is assumed that the relationship is Isum−9(T1) <Isum−9(T2)+Isum−9(B) in a region N=9. In this case, in the secondary transfer step, when the region N=1 passes through the secondary transfer portion T2, the secondary transfer target current value in the region S(T2) in the image is changed to a value higher than Iref(T2). Further, when the region N=9 passes through the secondary transfer portion T2, the secondary transfer target current value in the region S(T2) in the image is changed to a value lower than Iref(T2). This is true for the change in primary transfer voltage value.

Thus, for every divided region of the intermediary transfer belt 20 with respect to the circumferential direction, Isum−N(T1), Isum−N(T2) and Isum−N(B) are integrated, and depending on the maldistribution degree of the ion conductive agent in each region, the secondary transfer target current value or the primary transfer voltage value is changed. By this, a difference in degree of the maldistribution (localization) of the ion conductive agent in the intermediary transfer belt 20 with respect to the circumferential direction of the intermediary transfer belt 20 is taken into consideration, so that the bleed out of the ion conductive agent from the intermediary transfer belt 20 can be suppressed. Incidentally, a method of grasping the position of the intermediary transfer belt 20 with respect to the circumferential direction is not limited to the above-described method. For example, a technique for detecting the position of the intermediary transfer belt 20 with respect to the circumferential direction depending on a matching result of a profile of reflected light from the intermediary transfer belt 20 acquired during rotation of the intermediary transfer belt 20 by plural times or the like technique has been well known.

Further, as regards the ion conductive agent in the intermediary transfer belt 20, in the case where ease of the bleed out is different between the cationic electroconductive agent and the anionic electroconductive agent, depending on the ease of the bleed out, the secondary transfer target current value may also be changed. For example, the case where the anionic electroconductive agent does not readily bleed out from the outer peripheral surface of the intermediary transfer belt 20 and where only the cationic electroconductive agent is liable to bleed out from the outer peripheral surface of the intermediary transfer belt 20 will be considered. Incidentally, the constitution in which the electroconductive brush 70 is provided similarly as in the embodiment 3 will be described as an example. In this case, the secondary transfer target current value or the primary transfer voltage value is changed in a condition of Isum(T1)>Isum(T2)+Isum(B). On the other hand, in a condition of Isum(T1)<Isum(T2)+Isum (B), the secondary transfer target current value or the primary transfer voltage value may also be unchanged. That is, the following control may also be carried out depending on the printing mode. That is, in the operation in the full-color image mode, the secondary transfer target current value or the primary transfer voltage value is changed in the region S(T2) or in the region S(T1). On the other hand, in the operation in the monochromatic mode, the secondary transfer target current value or the primary transfer voltage value is unchanged in the region S(T2) or in the region S(T1).

Further, in the above-described embodiments, the monochromatic mode was the black (single color) mode in which the image formation is carried out in the image forming portion 1*d* for black, but may also be a mode in which a single color image is formed in the image forming portion 1 for another color.

Further, in the above-described embodiments, each of the primary transfer member and the secondary transfer member was a roller-shaped member, but may also be a brush-like member, a sheet-like member, or the like.

Further, in the above-described embodiments, only one threshold of the coverage was set, but a plurality of thresholds different in value from each other may also be set, so that the secondary transfer target current value or the primary transfer voltage value may also be changed stepwise depending on the coverage.

Further, in the above-described embodiments, the four image forming portions were provided in the image forming apparatus, but it may only be required that at least four, for example, five or more (for example, six) image forming portions be provided.

Further, a constitution in which a roller (inner roller) corresponding to the secondary transfer opposite roller in the above-described embodiments is used as the secondary transfer member and in which to this roller, the secondary transfer voltage of the same polarity as the normal change polarity of the toner is applied may also be employed. In this case, a roller (outer roller) corresponding to the secondary transfer roller in the above-described embodiments is used as an opposite roller, and this roller may only be required to be electrically grounded.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-100558 filed on Jun. 9, 2020, which is hereby incorporated by reference herein in its entirety.

What is claimed is:

1. An image forming apparatus comprising:

a plurality of image bearing members each configured to bear a toner image;

an intermediary transfer member configured to feed the toner image, primary-transferred from each of said image bearing members, for secondary-transferring the toner image onto a recording material, said intermediary transfer member being a rotatable endless member having ion conductivity;

a plurality of primary transfer members provided corresponding to said image bearing members, respectively, and each configured to form a primary transfer portion where the toner image is primary-transferred from said corresponding image bearing member onto said intermediary transfer member, wherein each of said primary transfer members primary-transfers the toner image from said corresponding image bearing member onto said intermediary transfer member under application of a first transfer voltage thereto;

a first applying portion configured to apply the first transfer voltage to said primary transfer members;

a secondary transfer member configured to form a secondary transfer portion where the toner image is secondary-transferred from said intermediary transfer member onto the recording material, wherein said secondary transfer member secondary-transfers the toner image from said intermediary transfer member onto the recording material under application of a second transfer voltage thereto;

a second applying portion configured to apply the second transfer voltage to said secondary transfer member; and a controller configured to carry out control of said second applying portion, wherein on the basis of image information, image formation is carried out in an operation in a first mode and in an operation in a second mode in which a number of said image bearing members on which the toner image is formed is less than that in the first mode and in which a number of said primary transfer members to which the first transfer voltage is applied is less than that in the first mode, wherein on the basis of the image information, said controller controls the second transfer voltage applied to said secondary transfer member during the secondary transfer of an image to be formed on a single recording material so as to be different between a first voltage when a first region, in which a coverage indicating a ratio occupied by an image region per predetermined area is a first coverage, passes through the secondary transfer portion and a second voltage when a second region, in which the coverage is a second coverage larger than the first coverage passes through the secondary transfer portion, and wherein said controller controls a change amount of the first voltage with respect to the second voltage so as to be different between the first mode and the second mode.

2. An image forming apparatus according to claim 1, wherein said controller controls the second transfer voltage so that an absolute value of the first voltage is greater than an absolute value of the second voltage in the first mode and so that the absolute value of the first voltage is less than the absolute value of the second voltage in the second mode.

3. An image forming apparatus according to claim 1, wherein said controller carries out control so that in the first mode, an integrated value of a first transfer current flowing through the primary transfer portions during image formation is greater than an integrated value of a second transfer current flowing through the secondary transfer portion during the image formation and so that in the second mode, the integrated value of the second transfer current flowing through the secondary transfer portion during the image formation is greater than the integrated value of the first transfer current flowing through the primary transfer portions during the image formation.

4. An image forming apparatus according to claim 1, wherein said controller carries out control so that in the first mode, toner images are formed on at least four image bearing members and the first transfer voltage is applied to said primary transfer member corresponding to each of said at least four image bearing members and so that in the second mode, the toner image is formed on one of said image bearing members and the first transfer voltage is applied to said primary transfer member corresponding to said one of said image bearing members.

5. An image forming apparatus according to claim 1, wherein said controller carries out control so that an absolute value of the change amount of the first voltage with respect to the second voltage in the first mode and an absolute value of the change amount of the first voltage with respect to the second voltage in the second mode are different from each other.

6. An image forming apparatus according to claim 1, wherein said controller carries out control so that an absolute value of the change amount of the first voltage with respect to the second voltage in a case that a ratio occupied by the first region in the image subjected to the secondary transfer is a first ratio is less than an absolute value of the change amount of the first voltage with respect to the second voltage in a case that the ratio is a second ratio less than the first ratio.

7. An image forming apparatus according to claim 1, wherein on the basis of the image information, said controller controls the voltage applied to said primary transfer members during the primary transfer of an image to be formed on a single recording material so as to be different between a third voltage when a third region in which the coverage indicating the ratio occupied by the image region per predetermined area is a third coverage passes through the primary transfer portion and a fourth voltage when a fourth region in which the coverage is a fourth coverage passes through the primary transfer portion, and wherein said controller controls a change amount of the third voltage with respect to the fourth voltage so as to be different between the first mode and the second mode.

8. An image forming apparatus according to claim 1, wherein said controller controls the voltage so that the first voltage and the second voltage are different from each other in a case that a region in which the coverage is less than a predetermined threshold is the first region and a region in which the coverage is not less than the predetermined threshold is the second region.

9. An image forming apparatus according to claim 8, wherein a region in which the coverage is less than the predetermined threshold and a print ratio is less than another threshold is the first region.

10. An image forming apparatus according to claim 8, wherein said controller carries out control so that the predetermined threshold of the coverage is changed on the basis of at least one of an environment, an image forming mode and a kind of the recording material.

11. An image forming apparatus according to claim 1, further comprising a voltage applying member provided separately from said primary transfer members and said secondary transfer member and configured to apply a voltage to said intermediary transfer member.

12. An image forming apparatus according to claim 1, further comprising an acquiring portion configured to acquire first information on an integrated value of a current flowing from an inner peripheral surface side to an outer peripheral surface side of said intermediary transfer member and second information on a current flowing from the outer peripheral surface side to the inner peripheral surface side of said intermediary transfer member, wherein on the basis of a difference between the integrated value of the current indicated by the first information and the integrated value of the current indicated by the second information, said controller controls the voltage so that the first voltage and the second voltage are different from each other.

13. An image forming apparatus according to claim 12, wherein in a case that the difference is less than a predetermined threshold, said controller does not control the voltage so that the first voltage and the second voltage are different from each other.

14. An image forming apparatus according to claim 13, wherein in a case that the integrated value of the current indicated by the first information and the integrated value of the current indicated by the second information are substantially the same, said controller does not control the voltage so that the first voltage and the second voltage are different from each other.

15. An image forming apparatus according to claim 12, wherein said controller carries out control so that an absolute value of the change amount of the first voltage with respect to the second voltage is a first value in a case that the difference is less than a predetermined threshold and so that the absolute value of the change amount of the first voltage with respect to the second voltage is a second value greater than the first value in a case that the difference is not less than the predetermined threshold.

16. An image forming apparatus according to claim 12, wherein said controller controls the change amount of the first voltage with respect to the second voltage so that the difference becomes small.

17. An image forming apparatus according to claim 12, wherein said acquiring portion acquires the first information and the second information for each of a plurality of regions obtained by division of said intermediary transfer member with respect to a circumferential direction of said intermediary transfer member, and wherein on the basis of the difference, said controller carries out control so that the first voltage and the second voltage are different from each other for each of the regions of said intermediary transfer member.

18. An image forming apparatus comprising:

a plurality of image bearing members each configured to bear a toner image;

an intermediary transfer member configured to feed the toner image, primary-transferred from each of said image bearing members, for secondary-transferring the toner image onto a recording material, said intermediary transfer member being a rotatable endless member having ion conductivity;

a plurality of primary transfer members provided corresponding to said image bearing members, respectively, and each configured to form a primary transfer portion where the toner image is primary-transferred from said corresponding image bearing member onto said intermediary transfer member, wherein each of said primary transfer members primary-transfers the toner image from said corresponding image bearing member onto said intermediary transfer member under application of a first transfer voltage thereto;

a first applying portion configured to apply the first transfer voltage to said primary transfer members;

a secondary transfer member configured to form a secondary transfer portion where the toner image is secondary-transferred from said intermediary transfer member onto the recording material, wherein said secondary transfer member secondary-transfers the toner image from said intermediary transfer member onto the recording material under application of a second transfer voltage thereto;

a second applying portion configured to apply the second transfer voltage to said secondary transfer member; and a controller configured to carry out control of said first applying portion, wherein on the basis of image information, image formation is carried out in an operation in a first mode and in an operation in a second mode in which a number of said image bearing members on which the toner image is formed is less than that in the first mode and in which a number of said primary transfer members to which the first transfer voltage is applied is less than that in the first mode, wherein on the basis of the image information, said controller controls the first transfer voltage applied to said primary transfer members during the primary transfer of an image to be formed on a single recording material so as to be different between a first voltage when a first region, in which a coverage indicating a ratio occupied by an image region per predetermined area is a first coverage, passes through the primary transfer portions and a second voltage when a second region, in which the coverage is a second coverage larger than the first coverage, passes through the primary transfer portions, and wherein said controller controls a change amount of the first voltage with respect to the second voltage so as to be different between the first mode and the second mode.

19. An image forming apparatus according to claim 18, wherein said controller controls the second transfer voltage so that an absolute value of the first voltage is less than an absolute value of the second voltage in the first mode and so that the absolute value of the first voltage is greater than the absolute value of the second voltage in the second mode.

20. An image forming apparatus according to claim 18, wherein said controller carries out control so that in the first mode, an integrated value of a first transfer current flowing through the primary transfer portion during image formation is greater than an integrated value of a second transfer current flowing through the secondary transfer portion during the image formation and so that in the second mode, the integrated value of the second transfer current flowing through the secondary transfer portion during the image formation is greater than the integrated value of the first transfer current flowing through the primary transfer portion during the image formation.

21. An image forming apparatus according to claim 18, wherein said controller carries out control so that in the first mode, toner images are formed on at least four image bearing members and the first transfer voltage is applied to said primary transfer member corresponding to each of said at least four image bearing members and so that in the second mode, the toner image is formed on one of said image bearing members and the first transfer voltage is applied to said primary transfer member corresponding to said one of said image bearing members.

22. An image forming apparatus according to claim 18, wherein said controller carries out control so that an absolute value of the change amount of the first voltage with respect to the second voltage in the first mode and an absolute value of the change amount of the first voltage with respect to the second voltage in the second mode are different from each other.

23. An image forming apparatus according to claim 18, wherein said controller carries out control so that an absolute value of the change amount of the first voltage with respect to the second voltage in a case that a ratio occupied by the first region in the image subjected to the primary transfer is a first ratio is less than an absolute value of the change amount of the first voltage with respect to the second voltage in a case that the ratio is a second ratio less than the first ratio.

24. An image forming apparatus comprising:

a plurality of image bearing members each configured to bear a toner image;

an intermediary transfer member configured to feed the toner image, primary-transferred from each of said image bearing members, for secondary-transferring the toner image onto a recording material, said intermediary transfer member being a rotatable endless member having ion conductivity;

a plurality of primary transfer members provided corresponding to said image bearing members, respectively, and each configured to form a primary transfer portion where the toner image is primary-transferred from said corresponding image bearing member onto said intermediary transfer member, wherein each of said primary transfer members primary-transfers the toner image from said corresponding image bearing member onto said intermediary transfer member under application of a first transfer voltage thereto;

a first applying portion configured to apply the first transfer voltage to said primary transfer members;

a secondary transfer member configured to form a secondary transfer portion where the toner image is secondary-transferred from said intermediary transfer member onto the recording material, wherein said secondary transfer member secondary-transfers the toner image from said intermediary transfer member onto the recording material under application of a second transfer voltage thereto;

a second applying portion configured to apply the second transfer voltage to said secondary transfer member; and a controller configured to carry out control of said second applying portion, wherein said controller controls the second transfer voltage applied to said secondary transfer member when a single recording material passes through the secondary transfer portion so as to be different between a first voltage when a marginal portion of the recording material onto which the toner image is not transferred passes through the secondary transfer portion and a second voltage when a region of the recording material onto which the toner image is transferred passes through the secondary transfer portion, and wherein said controller carries out control so that an absolute value of the first voltage is greater than an absolute value of the second voltage.

* * * * *